US009283444B2

(12) United States Patent
Cohen et al.

(10) Patent No.: US 9,283,444 B2
(45) **Date of Patent: *Mar. 15, 2016**

(54) DIRECT CONTACT RACQUET

(71) Applicant: Hand to Hand Racket Sports, Inc., McLean, VA (US)

(72) Inventors: Alain J. Cohen, McLean, VA (US); Darius Firouzgar, Arlington, VA (US); Marc A. Cohen, McLean, VA (US)

(73) Assignee: HAND TO HAND RACKET SPORTS, INC., McLean, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/800,217

(22) Filed: Jul. 15, 2015

(65) Prior Publication Data

US 2015/0314172 A1 Nov. 5, 2015

Related U.S. Application Data

(63) Continuation of application No. 13/445,731, filed on Apr. 12, 2012, now Pat. No. 9,101,801.

(60) Provisional application No. 61/474,363, filed on Apr. 12, 2011.

(51) Int. Cl.

| | |
|---|---|
| ***A63B 59/00*** | (2015.01) |
| ***A63B 49/00*** | (2015.01) |
| ***A63B 71/14*** | (2006.01) |
| ***A63B 71/00*** | (2006.01) |
| ***A63B 49/02*** | (2015.01) |

(52) U.S. Cl.

CPC ..... *A63B 49/02* (2013.01); *A63B 49/00* (2013.01); *A63B 59/007* (2013.01); *A63B 59/0025* (2013.01); *A63B 60/08* (2015.10); *A63B 60/10* (2015.10); *A63B 60/12* (2015.10); *A63B 60/40* (2015.10); *A63B 71/141* (2013.01); *A63B 2071/0063* (2013.01); *A63B 2209/10* (2013.01); *A63B 2210/50* (2013.01)

(58) Field of Classification Search

CPC ..... A63B 49/00; A63B 49/02; A63B 59/00; A63B 59/0025; A63B 59/007; A63B 71/00; A63B 71/141

USPC ..... 473/524, 518, 525, 527, 528, 533, 463

See application file for complete search history.

(56) References Cited

U.S. PATENT DOCUMENTS

| | | | | |
|---|---|---|---|---|
| 1,523,899 | A | 1/1925 | Rittenhouse | |
| 4,516,774 | A | 5/1985 | Nankivell | |
| 9,101,801 | B2 * | 8/2015 | Cohen ..... | A63B 59/0025 |

FOREIGN PATENT DOCUMENTS

| | | |
|---|---|---|
| CH | 598833 | 5/1978 |
| DE | 429962 | 6/1926 |

OTHER PUBLICATIONS

International Application No. PCT/US2012/033349, International Search Report and Written Opinion mailed Sep. 25, 2012, 18 pgs.

*Primary Examiner* — Raleigh W Chiu

(74) *Attorney, Agent, or Firm* — Clyde E. Findley

(57) ABSTRACT

The present invention relates to a direct contact racquet or "DCR." In order to enhance the feel experienced by the player, the DCR is designed to maximize the contact between the player's hand and the ball, while still making use of a string-bed or other form of contact to provide a strike surface for the ball. In one embodiment, the strike surface is positioned on one side of the player's hand, such as the palm side or the back of the hand. In particular, a gripping surface for a player's hand is provided behind the string bed. The gripping surface may be shaped in various ways so that a player can comfortably grip it. In addition, the gripping surface may provide a clearance from the string bed when striking a ball. Therefore, the DCR places a user's hand directly behind the string bed surface used to strike the ball. In another embodiment, the player's hand is placed between two strike surfaces to allow striking of a ball using either side of the player's hand.

10 Claims, 41 Drawing Sheets

DIRECT CONTACT RACQUET

CROSS-REFERENCE TO RELATED APPLICATIONS

The present invention claims priority to U.S. Provisional Application No. 61/474,363, filed Apr. 12, 2011, entitled "DIRECT CONTACT RACQUET," which is herein incorporated by reference in its entirety.

FIELD

The present invention relates to sporting equipment and games, and more particular, embodiments of the present invention relate to a racquet for use in sports, such as tennis.

BACKGROUND

In tennis, the player uses a tennis racquet to execute a basic stroke. The tennis racquet serves as an extension of the player's arm. When properly executed, the racquet makes contact with the ball, strikes, and follows-through, to send the ball back on its intended direction of travel.

A tennis racquet is generally composed of a handled frame with an open head across which strings are arranged. Modern racquets vary in length, weight, and head size, but are generally about 24-27 inches. The head size and string bed gives power to a tennis stroke. A larger head usually means more power and more area for off-center hits, while a smaller head offers more fixed control. The string-bed pattern is also an important aspect, as a tighter string pattern allows more control and a more open pattern offers increased potential for power and spin. The handle length and grip size are also important aspects since the player must be able to grasp the handle to control the swing.

However, with a conventional racquet, the player's hand is displaced from the head of the racquet. This creates a larger distance between the player's hand and the intended point of contact. For example, a slight turn of the wrist will rotate the string bed into an upward angle. At this angle, after contact the ball will fly upwards and too far over the net. Typically, the player must focus on gripping the handle and following-through on the stroke with a straight wrist and forearm.

Unfortunately, it is difficult for players to learn how to properly use a racquet and gain skill in playing a sport like tennis. Therefore, it would be beneficial to produce a racquet that maximizes the contact between the player's hand and the ball. This permits a more accurate feel for the ball and produces a better stroke. A better feel allows for greater control, speed, and overall enjoyment of the sport.

SUMMARY

The embodiments provide a new type of racquet that can be used in sports, such as tennis. For purposes of convenience, the present disclosure may refer to this new type of racquet as a "Direct Contact Racquet," or "DCR". As will be further described, the racquet is designed such that a player's hand is positioned generally behind the point of contact of the racquet. It is believed that this form of hand positioning produces a better "feel" for the ball and, for example, enables a more accurate tennis stroke by a player or user.

In some embodiments, the contact surface of the DCR comprises a string-bed that may resemble the "head" portion of a conventional racquet or other type of paddle for striking a ball, such as a tennis ball. In other embodiments, the contact surface of the DCR may comprise other types of surfaces such as a solid surface or a woven surface. Those skilled in the art will understand that any striking surface suitable for hitting a ball, like a tennis ball, a racquetball, and the like, may be used in the embodiments of the present invention.

In one embodiment, the head of the DCR may comprise a gripping member, such as a bar, that spans across the head and provides a gripping surface for the player's hand. In other embodiments, the head of the DCR may comprise various types of attachment mechanisms to couple a players' hand to the DCR. To use the DCR, a player may grip the DCR with their hand or wear a glove, which isolates and protects the hand. The glove may have mounting or attachment points designed to attach to the DCR. Gloves may come in different sizes to fit an individual's hand. The DCR can be one-sided, for forehand only or backhand only play, or dual-sided, for both forehand and backhand play.

In one embodiment, a racquet for use with a ball may comprise a first frame defining a string bed as a striking surface for striking a ball and a second frame, coupled to the first frame, defining a string bed as a striking surface for striking the ball. A cross bar is interposed between the first and second frames and is configured to accommodate fingers of the hand of the user. The cross bar also comprises a set of holes through which the user may insert one or more fingers.

BRIEF DESCRIPTION OF THE DRAWINGS

The accompanying drawings, which are incorporated in and constitute a part of this specification, illustrate several embodiments of the disclosure and together with the description, serve to explain the principles of the disclosure.

DESCRIPTION OF THE EMBODIMENTS

Figure 1:
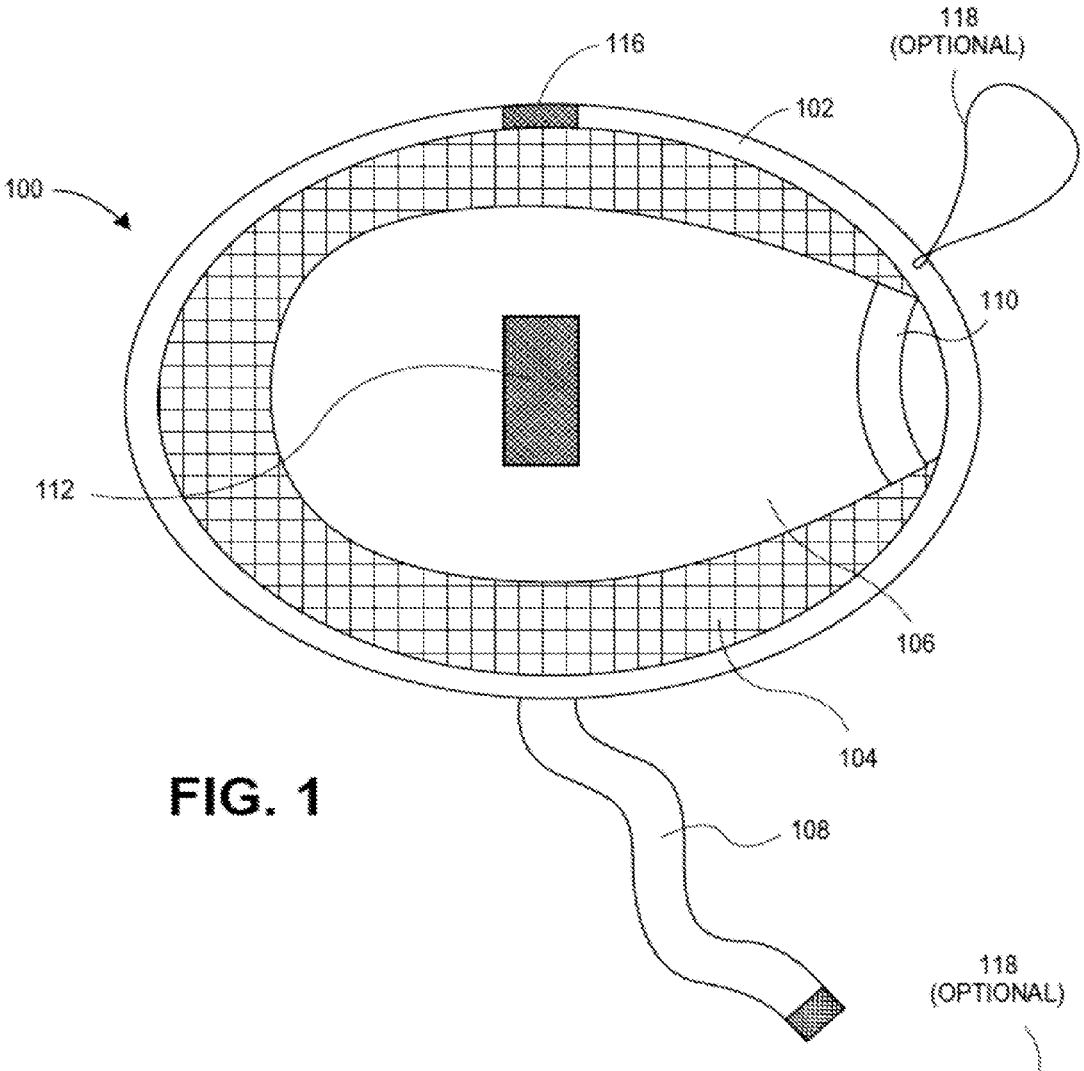
FIG. 1 shows a first embodiment of a direct contact racquet that is consistent with the principles of the present invention.

The present disclosure describes a new type of sports equipment used to play racket sports with an enhanced level of "feel" for the ball. "Feel" refers to the sensation that the player of the sport experiences when making contact with the ball via the racket. Better feel generally provides the player with greater control of the ball trajectory and speed, and also greater enjoyment of the sport. The purpose of the new racket design is to spawn new variations of racket sports, as well as to provide new training approaches for existing racket sports, such as tennis, racket ball, badminton, paddle tennis, or squash.

In order to enhance the feel experienced by the player, the DCR is designed to maximize the contact between the player's hand and the ball, while still making use of a string-bed or other form of contact to provide a strike surface for the ball. Thus, while the hand does not come into direct contact with the ball (as it does in certain sports or games), the distance between the hand and the ball at the time it is struck is significantly reduced when compared to other racket sport equipment.

Furthermore, in accordance with the principles of the present invention, the player's hand is tightly integrated with the strike surface of the DCR in order to approximate the sensation that the player is hitting the ball with his or her own hand, despite using the string-bed portion of the DCR to actually make contact with the ball. To accomplish this, the DCR permits the player's hand to be placed directly behind the string bed surface used to strike the ball. That is to say, the string bed is positioned between the hand and the ball.

The DCR does not make use of a handle, stem, shaft, or "throat" as is commonly found in rackets used for sports. Rather, as described above, the hand is positioned behind the strike surface, i.e., the string bed, relative to a ball being struck. In one embodiment, the string bed is held in place and the strings are kept sufficiently taut by a frame, which may resemble the portion of an ordinary racket known as the "head". Since the term "head" is applicable for a racket with a handle, in the DCR design, the term "strike surface" is used to refer to this part of the DCR.

In the DCR design, the strike surface is not directly in contact with the bare hand. In one embodiment, such contact is avoided because direct contact with a player's hand may produce discomfort and or harm to the hand when the ball is struck due to pressure and friction. Instead, the player's hand is attached to the DCR substantially behind strike surface of the DCR, with sufficient clearance to allow for deflection of the strike surface during contact with a ball. In one embodiment, the player may grip any part of the DCR with their bare hand, i.e., without the use of a glove. In another embodiment, the player may use a glove to assist in gripping or attaching their hand to the DCR. The glove may also comprise features, such as cushioning, to protect the player's hand from excessive shock or vibration resulting from contact at the strike surface. The glove may be configured to sufficiently isolate and protect the hand so that the player can comfortably strike the ball.

For example, the DCR glove is made of sufficiently thick and cushioned material to provide adequate protection. This material could consist of, for instance, leather, cloth, nylon, or other materials commonly used to manufacture gloves. The glove may make use of multiple layers of material in order to provide additional thickness and therefore insulation of the hand.

The DCR glove may be equipped with or more "mount points" designed to attach to the strike surface. The strike surface has, at least, a partially rigid portion, which we will call the "strike surface frame", or simply, "frame". The frame presents one or more mount points of its own, which are designed to be attached with the mount point(s) of the glove. There are several possible methods of attachment between the glove mount point(s) and the strike surface mount point(s).

The selected method of attachment places different requirements on the form of the mount points and the materials they consist of.

Some possible methods are: binding by glue or epoxy; interlocking mechanical parts, such as a tongue and groove with locking mechanism, or a rod-and-sleeve assembly with a pin to keep the interlocking parts together, a nut-and-bolt assembly, and the like. The mount points on the strike surface can either be separate parts that are attached to the frame, or integrated directly into the frame itself. For example, these mount points may be protuberances of the frame itself, thus requiring no additional mechanical parts For the glove mount points, the mount points are more typically a separate physical part that must then be attached to the glove. The embodiments may comprise a number of approaches to attach the mount points to the glove. These include: embedding a part of the mount point within the fabric of the glove; using a glue or other adhesive to bind the mount point to the fabric of the glove; using a sewing technique to weave a thread through one or more layers of the glove as well as through threading holes (similar to a button on a garment) on the mount point.

In addition, the embodiments may provide shock absorption integrated into the mount points (e.g., springs or pads). In another embodiment, the frame may be a flexible and "shapeable" strike surface frame. In yet another embodiment, the strike surface may be a continuous strike surface (e.g., hard paddle instead of strings).

For purposes of illustration, the present disclosure provides various examples of a one-sided DCR. In particular, the present disclosure provides various examples of a one-sided DCR having a forehand configuration, i.e., the strike surface is placed on the palm side of the player's hand. Other embodiments of the DCR may be configured for a backhand type of stroke, i.e., the strike surface is placed on the backside or dorsal aspect of the player's hand. A one-sided DCR may be configured solely for a forehand or backhand stroke, or may be reconfigurable, such as with modular components for either a forehand or backhand stroke.

Those skilled in the art will also recognize that the present disclosure is also applicable to a dual-sided DCR, which can be applied for forehand and backhand play. Bonding or attaching two opposing frames may implement the dual-sided OCR. For example, the opposing frames may be fixated or detachable from each other such that both sides of the player's hand are provided with a striking surface. The opposing frames may be parallel when attached together. Alternatively, the opposing frames, when attached to each other, may be tapered or angled, for example, relative to each other. The angle of the opposing frames may be fixed or adjustable.

In addition, the opposing frames of the dual-sided OCR may be configured differently. For example, the forehand side of a dual-sided OCR may be shaped and sized differently than the backhand side. In some embodiments, the sides of the dual-sided OCR may be provided as a pair or provided separately to allow the player to select and customize each side of the DCR to their desired characteristics of play. Furthermore, the materials and construction of the dual-sided OCR may be modified in order to provide a desired weight, stiffness, and size. Other modifications may be apparent to those skilled in the art.

Figure 2:
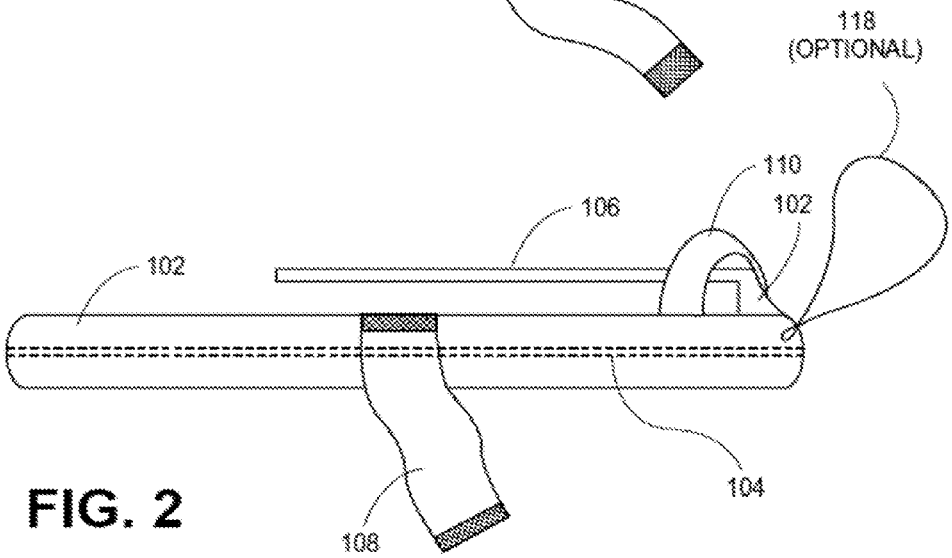
FIG. 2 shows a side view of the embodiment illustrated in FIG. 1.
Figure 3:
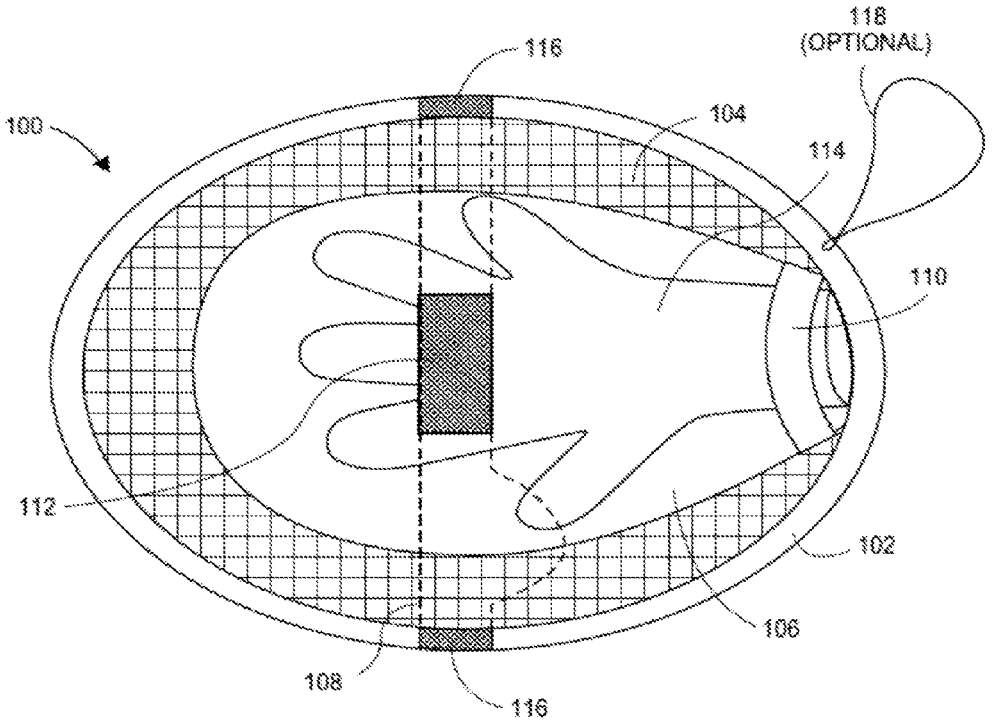
FIG. 3 shows the embodiment of FIG. 1 with a glove in place.
Figure 4:
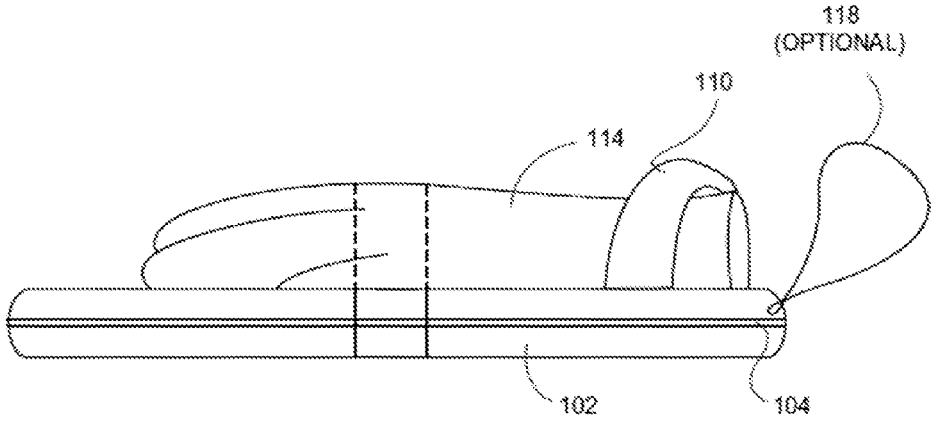
FIG. 4 shows a side view of the embodiment of FIG. 1 with the glove in place.
Figure 5:
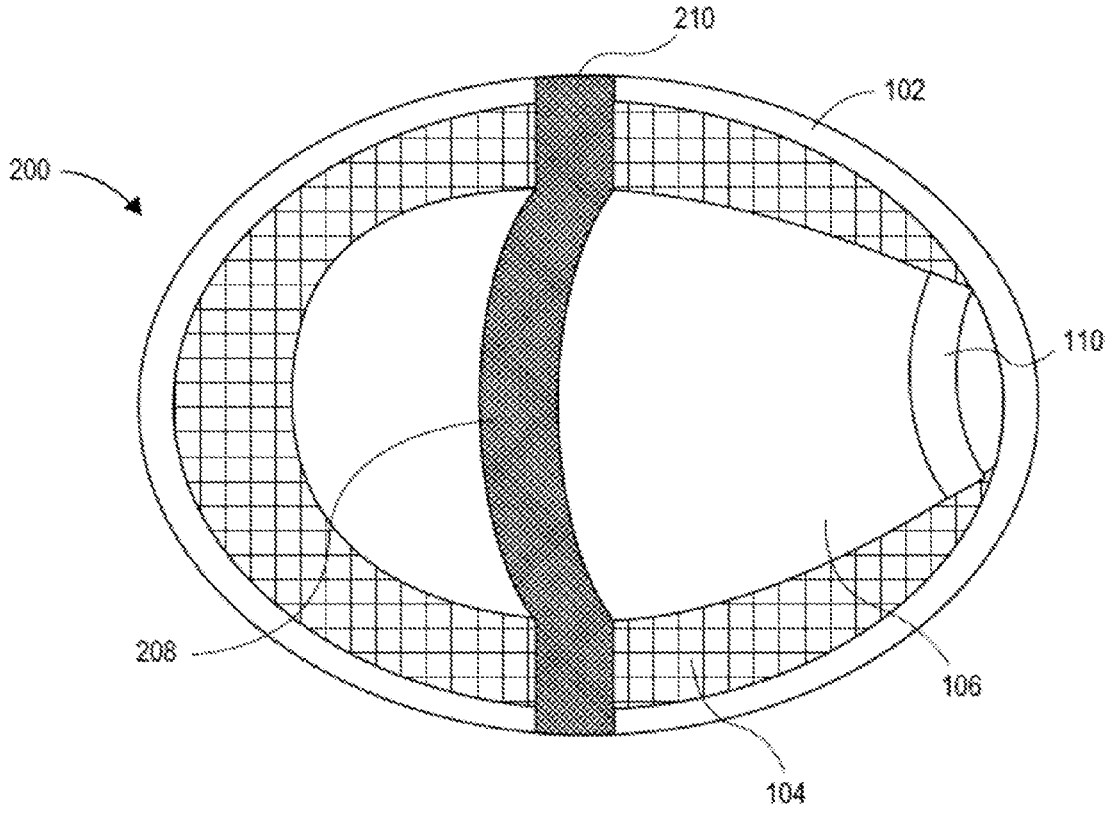
FIG. 5 shows a second embodiment of a direct contact racquet that is consistent with the principles of the present invention.
Figure 6:
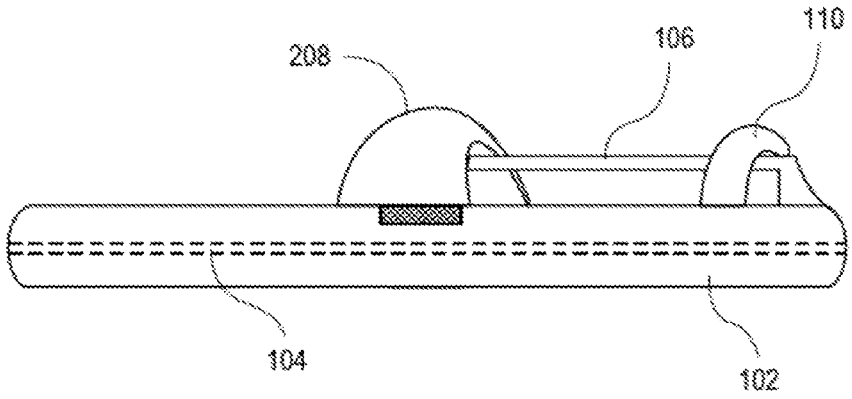
FIG. 6 shows a side view of the embodiment illustrated in FIG. 5.
Figure 7:
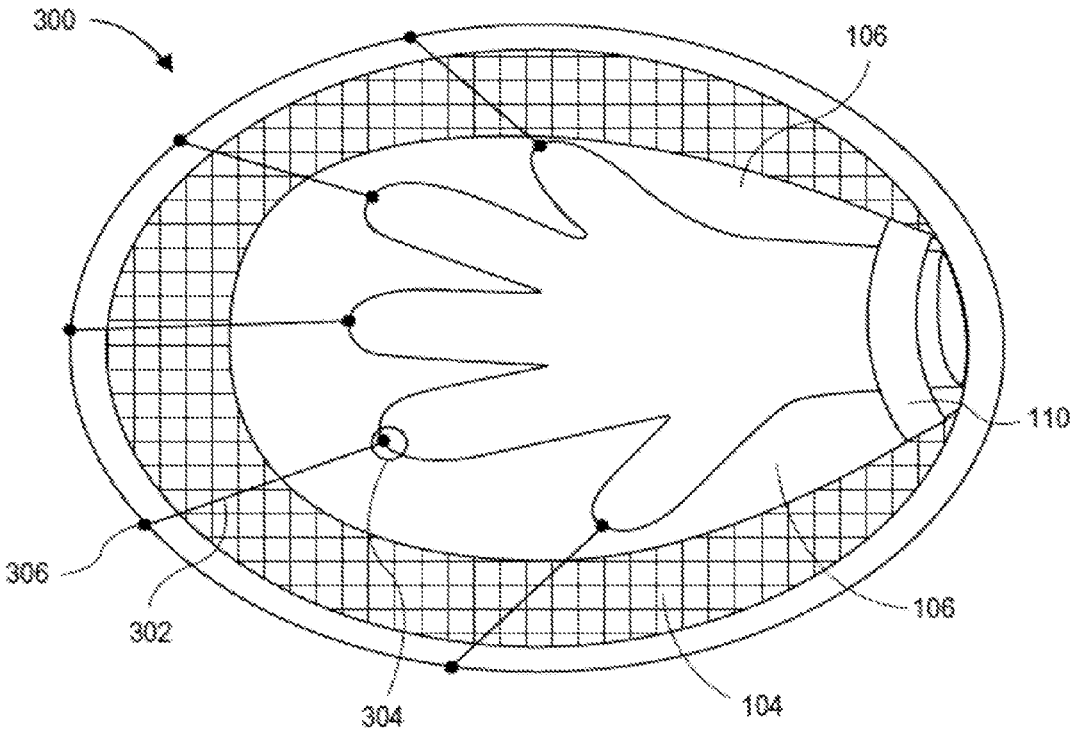
FIG. 7 shows a third embodiment of a direct contact racquet that is consistent with the principles of the present invention.
Figure 8:
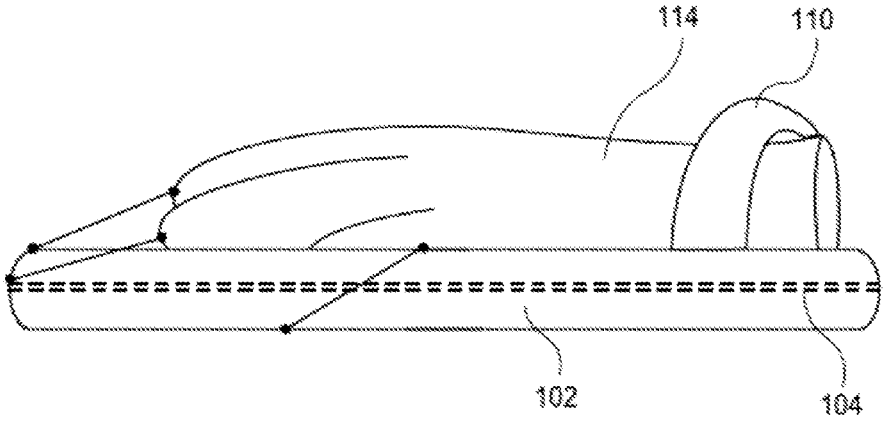
FIG. 8 shows a side view of the embodiment illustrated in FIG. 7.

Embodiments of the disclosure will now be described with reference to the accompanying figures, wherein like numerals refer to like elements throughout. For example, FIGS. 1-2 show a first embodiment of a direct contact racquet that is consistent with the principles of the present invention. FIGS. 3-4 show a second embodiment of a direct contact racquet that is consistent with the principles of the present invention. FIGS. 5-6 show a third embodiment of a direct contact racquet that is consistent with the principles of the present invention. FIGS. 7-8 show a fourth embodiment of a direct contact racquet that is consistent with the principles of the present invention. These figures will now be described in more detail below.

FIG. 1 shows a first embodiment of a direct contact racquet that is consistent with the principles of the present invention. As shown, a DCR 100 may comprise a frame 102, a string-bed 104, a gripping surface 106, a strap 108, a wrist strap 110, and a glove attachment 112. These components will now be described below.

The frame 102 provides a structural member for the DCR 100 and to provide a frame for the string-bed 104. The frame 102 may be constructed from various materials, such as graphite, wood, aluminum, steel, etc. The frame 102 may provide a striking surface of a suitable area for hitting a ball, such as a tennis ball, a racquetball, etc. In one embodiment, the frame 102 provides a striking surface of approximately 75 to 110 square inches. In addition, the frame 102 may be configured to have a desired weight, such as 6 to 12 ounces. As shown, the frame 102 may comprise a generally oval shape, e.g., similar to a tennis racquet. Of course, the frame 102 may comprise any shape, such as circular, elliptical, square, rectangular, etc.

The string-bed 104, in the embodiment shown, serves as an elastic striking surface for using the DCR 100 with a ball, such as a tennis ball. For example, the string-bed may be constructed similar to a tennis racquet, and thus, may use similar type of string as a tennis racquet. Such strings are well known to those skilled in the art. In the embodiments, the string-bed may have a range of mains and crosses, for example, 16-18 mains and 16-18 crosses. In addition, the tension of the string-bed 104 may be set in a similar fashion as a tennis racquet, such as approximately 60-70 pounds. Alternatively, the string-bed 104 may be strung with a lower or higher tension depending on the desired characteristics sought for the DCR 100.

The gripping surface 106 provides structural member for a mounting and gripping surface for the players' hand, with or without a glove. As shown, the gripping surface 106 may attach to the frame 102 at one or more points to provide structural integrity and to provide at least one structural component or member having a solid surface for a players' hand. The gripping surface 106 may attach to the frame 102 in various ways, for example, using one or more modular pieces along various slots or receiving holes provided in the frame 102. Of course, in other embodiments, the gripping surface 106 may have various sizes and shapes to accommodate a players' hand. In one embodiment, the gripping surface 106 may comprise attachment mechanisms for a glove, if used. The gripping surface 106 may be integrated with the frame 102 or may be a modular piece that can be detached from the frame 102. A modular configuration allows the DCR 100 to have interchangeable gripping surfaces that can be attached and detached.

The gripping surface 106 may be constructed from various materials, such as graphite or plastic that can provide an appropriately stiff and lightweight structure that is suited for a game such as tennis. In order to comfortably accommodate a players' hand with or without a glove, the gripping surface 106 may be smooth or have various features, such as knobs, indentations, and one or more bumps. As shown in FIGS. 1-2, the gripping surface 106 may be a flat structure. Alternatively, the gripping surface 106 may also be contoured or custom fit to a specific players' hand, or contoured to the shape of a hand in general. Furthermore, the gripping surface may be cushioned to assist in absorbing the impact experienced while using the DCR 100.

The strap 108 is a securing mechanism to hold the players' hand with or without a glove to the gripping surface 106. As shown, the strap 108 may generally span across the players' hand at the midpoint of the frame 102 using a buckle 116. The strap 108 may be secured by various mechanisms such as Velcro, clips, buckles, and the like. The strap 108 may be constructed from various materials such as nylon and may be elastic to permit stretching. Those skilled in the art will also recognize that the DCR 100 may comprise multiple straps to secure a players' hand.

The wrist strap 110 is designed to secure a players' wrist to the bottom of the DCR 100. As shown, the wrist strap 110 may be a single strap that generally wraps around a players' wrist. Alternatively, in the embodiments, a players' wrist may be secured to the DCR 100 in various ways while allowing a relatively free range of motion for the wrist during play. In addition, the DCR 100 may employ multiple wrist straps to secure the DCR to a player's wrist and/or arm. Of course, in other embodiments, the DCR 100 may be provided without a wrist strap or wrist strap that is removable at the discretion of the player. Various other types of securing mechanisms, such as loops, bracelets, etc. may be used in the embodiments to secure a player's hand or arm to the DCR 100. The wrist strap 110 may be constructed from various materials, such as nylon, rope, rubber, etc. and may be elastic to permit stretching.

The glove attachment 112 may be an optional component for those embodiments in which a player wears a glove to use the DCR 100. The glove attachment 112 secures the player's hand when using a glove. In the embodiment shown, the glove attachment 112 may be implemented using a Velcro-like pad. In other embodiments, the glove attachment 112 may be implemented using mechanisms, such as a clip, a buckle, a locking tab, etc. Alternatively, for those embodiments that do not require a player to wear a glove, the attachment 112 may be a cushioned or tacky surface that assists the player in holding the DCR 100.

As also shown, the DCR 100 may comprise a lanyard or strap 118 as another optional component. The lanyard 118 may be provided in lieu of or as a supplement to the wrist strap 110. The lanyard 118 may be primarily configured to keep the DCR 100 coupled to the player's hand or arm in the event that the player has lost grip of the DCR 100 or to allow the player to let go of the DCR 100 while maintaining it connected to their person. The lanyard 118 may be constructed from well-known materials, such as nylon, Velcro, rubber, etc.

FIG. 2 shows a side view of the embodiment illustrated in FIG. 1. As shown in FIG. 2, the side profile of the DCR 100 may be designed to have a relatively low profile relative to the width of frame 102. Of course, the DCR 100 may have different types of profiles to accommodate its components.

As also shown in FIG. 2, the gripping surface 106 may be placed a sufficient distance from the string bed 104 to avoid contact with the string bed 104, e.g., during impact with a ball. The distance of the gripping surface 106 may be varied based on various criteria, such as, the type of ball used, strings used in the DCR 100, size of the gripping surface 106. For example, the gripping surface 106 may be placed approximately 0.1 to 1 inches from the string bed 104.

Figure 2A:
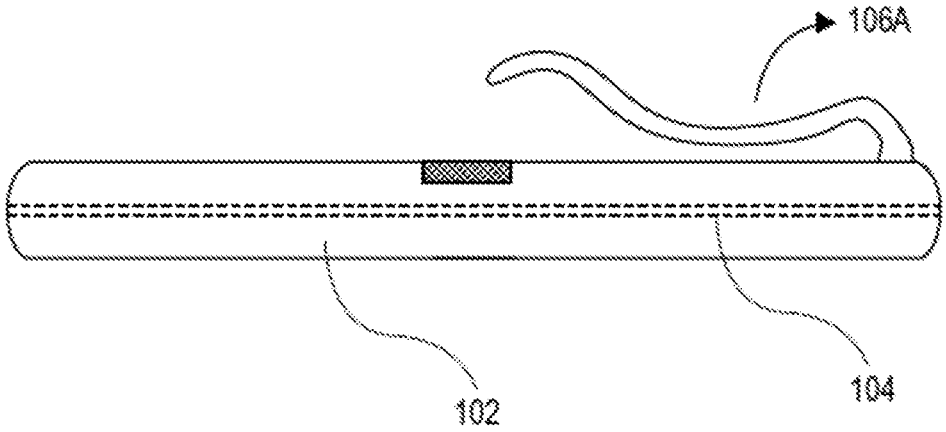
FIG. 2A shows a side view of an alternative embodiment having a contoured gripping surface that may conform to a player's hand with or without a glove.

Referring now to FIG. 2A, an alternative embodiment of the DCR 100 is shown. In particular, a gripping surface 106A may be contoured to conform to the shape of a player's hand. The gripping surface 106A may also comprise one or more cushioned areas, such as the palm area and wrist area to provide additional comfort. In addition, the gripping surface 106A may comprise one or more grooves, slots, or holes (not shown) to facilitate gripping of the DCR 100 by a player. Those skilled in the art will recognize that any form of ergonomic shape may be employed by the embodiments.

Figure 3A:
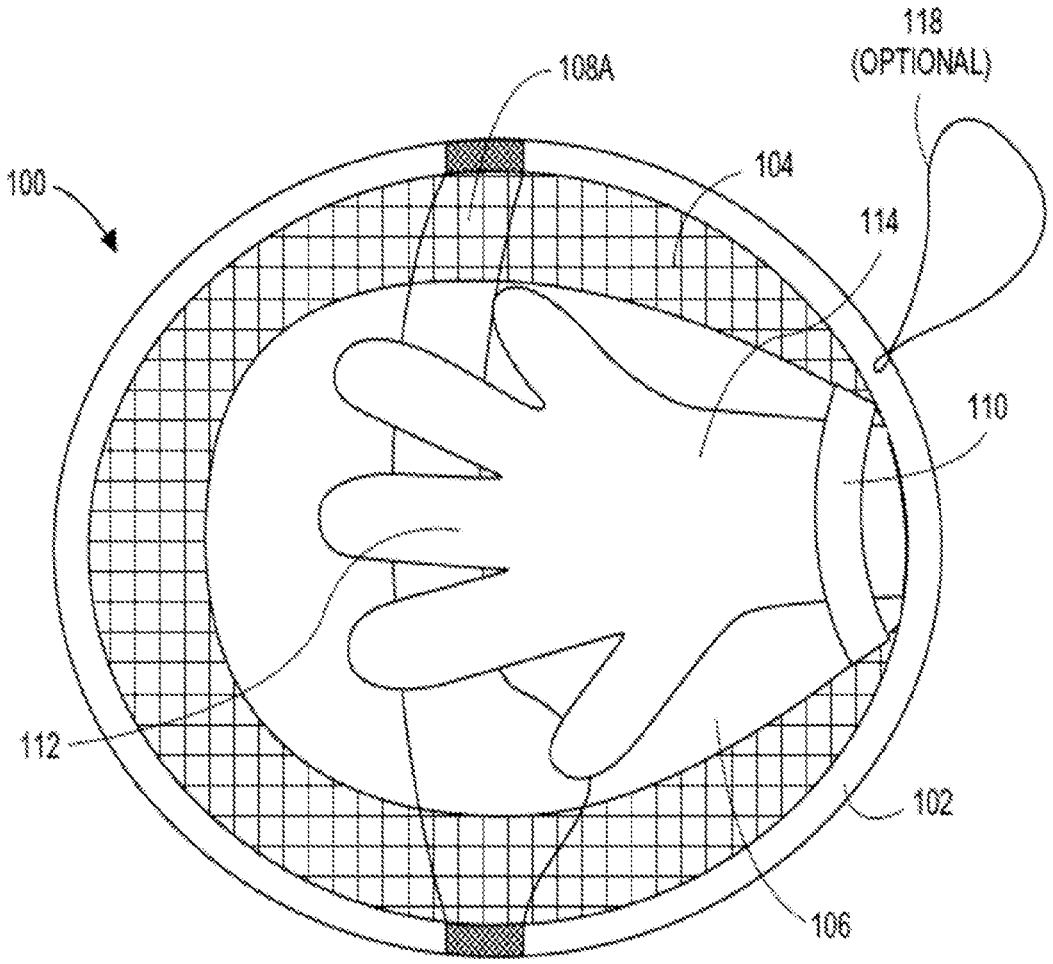
FIG. 3A shows an alternative embodiment in which the gripping arch is curved or shaped to conform to a player's fingers.

Of note, for purposes of illustration, the DCR 100 shown in FIGS. 1-2 was shown without a player's hand or glove in place. FIGS. 3-4 provide an exemplary view of the DCR 100 with a player using a glove 114. In particular, FIG. 3 shows top plan view of the DCR 100 illustrating a player with a glove in place. In addition, as shown in FIG. 3A, the gripping bar 208 may have a curved section or tab that extends to allow a player's thumb to comfortably rest on the gripping bar 208. Furthermore, as shown in FIG. 3A, a gripping bar 208A may be provided that has a generally curved shape or arc that ergonomically conforms to the relative lengths of a player's finger. The gripping bar 208A may be provided as a single piece or multiple pieces that are customizable for an individual player. Likewise, FIG. 4 shows a side view of the DCR 100 illustrating a player with a glove in place.

FIG. 5 shows a second embodiment of a direct contact racquet that is consistent with the principles of the present invention. FIG. 6 shows a side view of the embodiment illustrated in FIG. 5. As shown, the DCR 200 may comprise similar components as the DCR 100 shown in FIGS. 1-2, such as the frame 102, the string bed 104, the gripping surface 106, and the wrist strap 110. In this embodiment, the player may use the DCR 200 without the use of a glove.

The DCR 200, however, may comprise a different configuration. For example, as shown, a gripping bar or arch 208 may span across the gripping surface 106 and may be attached to the frame 102. The gripping bar 208 may be straight, flat or arched to serve as an efficient gripping or resting surface for a player's hand. For example, as shown, the gripping bar 208 may be a convex arch that extends up from the string bed 104. Alternatively, the gripping bar 208 may have a concave arch that bends toward the string bed 104 (not shown). In yet other embodiments, the gripping bar 208 may be straight or angled with various profile shapes, such as circular, oval, rectangular, etc. The angle and curvature of the gripping bar 208 may be fixed or adjustable. For example, the gripping bar 208 may be a single piece that is integrated or detachable from the frame 102. In other embodiments, the gripping bar 208 may comprise multiple pieces that allow a user to customize the shape and fit of the gripping bar 208 to their hand.

The gripping bar 208 may have a relatively smooth surface or may comprise various surface features. For example, the gripping bar 208 may be contoured to accommodate a player's hand, such as in a groove or slot. In addition, the gripping bar 208 may have one or more areas that are cushioned or roughened to assist in holding the DCR 200. The gripping bar 208 may be constructed from various materials, such as metal, wood, graphite, plastic, etc.

Grooves or slots may be implemented in several ways in the gripping bar 208. In some embodiments, the grooves or slots are intended to hold or place the player's fingers. Accordingly, the player's fingers may rest in a contoured slot; insert into one or more holes optionally having padding; placed on the gripping bar 208 in a slot and held in place with a strap, loop, or other securing mechanism. Furthermore, these features may be fixed or adjustable to accommodate different players.

Figure 6A:
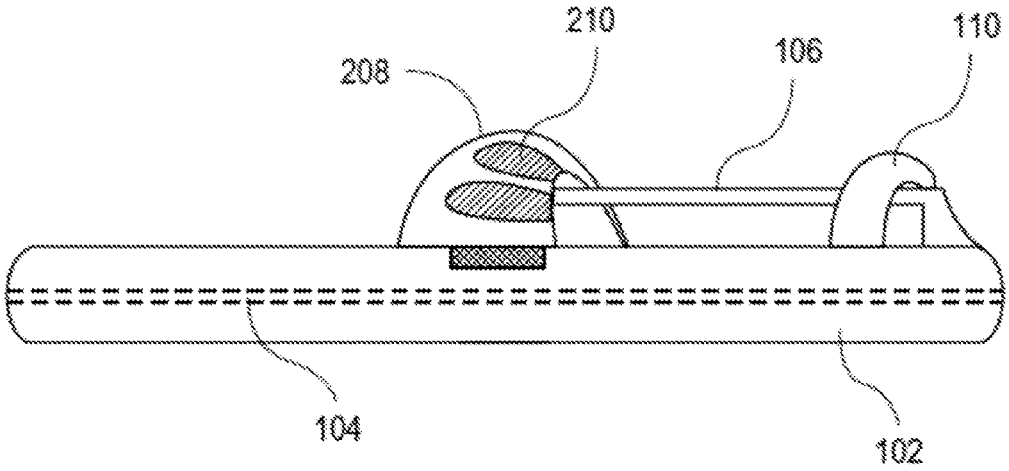
FIG. 6A shows an alternative embodiment in which the gripping arch may comprise slots or recesses for a player's hand or fingers.

For example, as shown in FIG. 6A, the gripping bar 208 may comprise various slots or recesses 210 that accommodate a player's fingers. The slots 210 may be designed to hold one or more fingers at a time. In addition, the slots 210 may be optionally cushioned or padded as desired. As noted, the slots 210 may be variable in size and shape to hold the fingers of a variety of players.

Figure 6B:
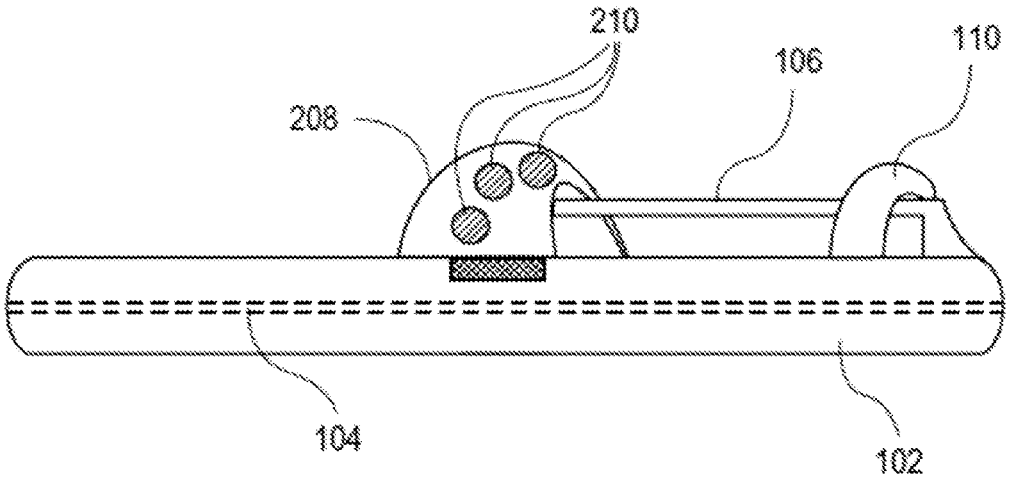
FIG. 6B shows an alternative embodiment in which the gripping arch may comprise holes for receiving one or more fingers of a player's hand.

As another example, as shown in FIG. 6B, the gripping bar 208 may comprise holes 210 into or through which a player may insert their fingers. The holes 210 may be designed to hold one or more fingers as well. The holes 210 may be shaped in various ways, such as U-shaped, circular, oval, rectangular, etc. For example, the hole 210 for the index finger may be configured as a through hole, while the holes 210 for other fingers, such as the thumb, may be close ended. The holes 210 may be cushioned or padded for the comfort of the player. Of course, the holes 210 may be variable in size and shape to accommodate different players.

Moreover, the gripping bar 208 may comprise various features that attach to a player's hand with or without a glove. For example, the gripping bar 208 may comprise one or more straps, one or more loops for the fingers, clips, and slots, that allow a player to lock their hand or glove to the gripping bar.

FIG. 7 shows a third embodiment of a direct contact racquet that is consistent with the principles of the present invention. FIG. 6 shows a side view of the embodiment illustrated in FIG. 5. As shown, the DCR 300 may have similar components to DCR 100, such as a frame 102, a string bed 104, gripping surface 106, and wrist strap 110.

However, in this embodiment, the DCR 300 is configured such that a player's hand is attached via the use of one or more attachment links 302. In particular, a player's glove 114 may comprise various mounting clips 304 that attach to links 302. The links 302 may then span to a respective frame mount 306 on the frame 102. The frame mounts 306 may be fixed or movable on the frame 102. The frame mounts 306 may also comprise various tensioning mechanisms, such as a screw, to allow for adjustment of the tension on link 302.

The links 302 may be constructed from various materials, such as wire, plastic, rubber, nylon, etc. The links 302 may come in various sizes to suit different player's hands and to provide a range of tensions. The links 302 may be configured to have various elasticity characteristics depending on the desired playability and feel of the DCR 300.

In the embodiment shown, each finger of the glove 114 is provided it's own link 302. In other embodiments, the fingers of the glove 114 may share one or more links. In yet other embodiments, only certain fingers of the glove 114, such as the thumb, forefinger, etc., may be provided a link 302. Any combination of these configurations is considered to be within the principles of the present invention.

Figure 9:
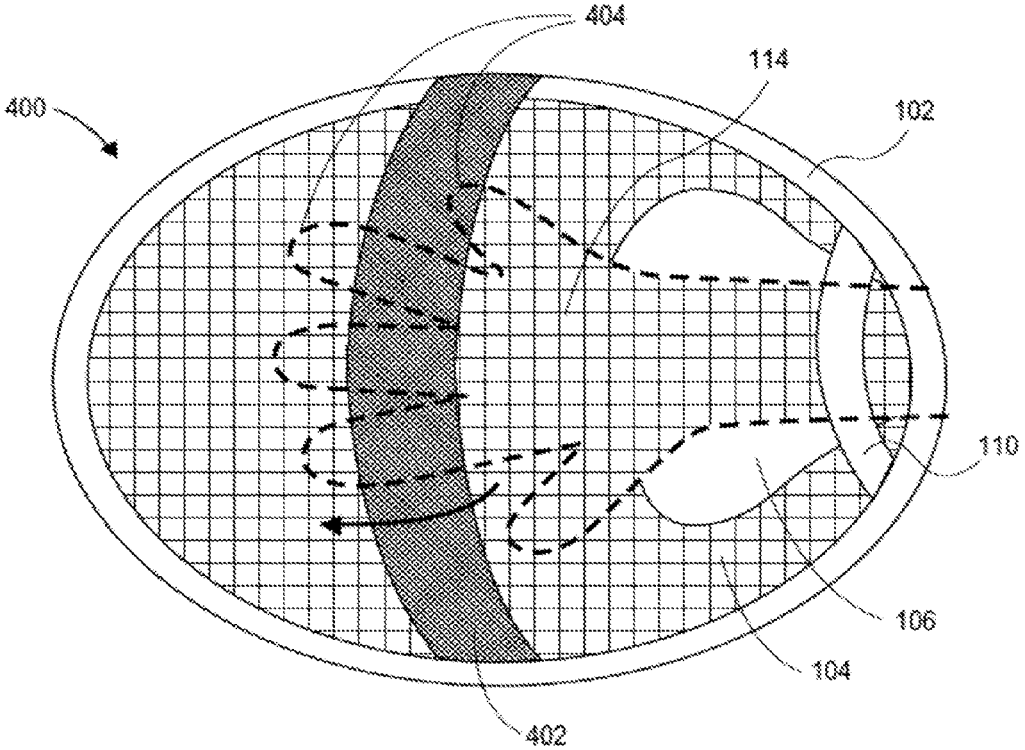
FIG. 9 shows a fourth embodiment of a direct contact racquet that is consistent with the principles of the present invention.

FIG. 9 shows a fourth embodiment of a direct contact racquet that is consistent with the principles of the present invention. FIG. 8 shows a side view of the embodiment illustrated in FIG. 7. In this embodiment, the gripping bar spans across the frame 102 and the DCR 400 does not require a gripping surface for the entire hand and is provided as an alternative design to the one illustrated, for example, in FIGS. 5-6. As shown, the DCR 400 may comprise similar components as the DCR 100 shown in FIGS. 1-2, such as the frame 102, the string bed 104, and the wrist strap 110.

The DCR 400, however, may comprise a different configuration. For example, as shown, a gripping bar or arch 402 may span across and may be attached to the frame 102. The gripping bar 402 may be flat or arched to serve as an efficient gripping or resting surface for a player's hand. For example, as shown, the gripping bar 402 may be a convex arch that extends up from the string bed 104. Alternatively, the gripping bar 402 may have a concave arch that bends toward the string bed 104 (not shown).

The gripping bar 402 may be sized and shaped to allow a player to wrap their fingers around the bar 402 or to simply grasp the bar 402. In other embodiments, the gripping bar 402 may provide various attachment mechanisms, such as holes, finger loops, clips, and slots that allow a player to securely fix their hand with or without a glove on the gripping bar 402. The gripping bar 402 may be constructed from various materials, such as metal, wood, graphite, plastic, etc.

The angle and curvature of the gripping bar 402 may be fixed or adjustable. The gripping bar 402 may be a single piece that is integrated or detachable from the frame 102. In other embodiments, the gripping bar 402 may comprise multiple pieces that allow a user to customize the shape and fit of the gripping bar 402 to their hand. The gripping bar 402 may also be fixed to single position on the frame 102, or may be provided on a range of positions on the frame 102 to suit a specific player.

The gripping bar 402 may have a relatively smooth surface or may comprise various surface features. For example, the gripping bar 402 may be contoured to accommodate a player's hand, such as in a groove or slot. In addition, the gripping bar 402 may have one or more areas that are cushioned or roughened to assist in holding the DCR 400.

In other embodiments of the DCR, a less expansive plate or form of gripping surface 106 may be employed to allow placement of the player's hand (with or without a glove) above the string bed with a minimal structure. For example, a smaller gripping surface 106 may be provided for the base of the palm and attached at or near the base of the frame 102. In these embodiments, the fingertips or portion of the fingers would reside in holes on the gripping bar or rest in slots or grooves on the gripping bar and the base of the palm may rest on the gripping surface 106 at the base of the frame 102. These pieces, such as the one for the palm, may be contoured and/or cushioned. The pieces may be constructed from a variety of materials, such as plastic, graphite, rubber, etc., and padded, such as with leather. The palm-resting piece on the gripping surface 106 may be sized to avoid overlapping the string bed 104 or overlap the string bed 104 minimally.

Figure 10:
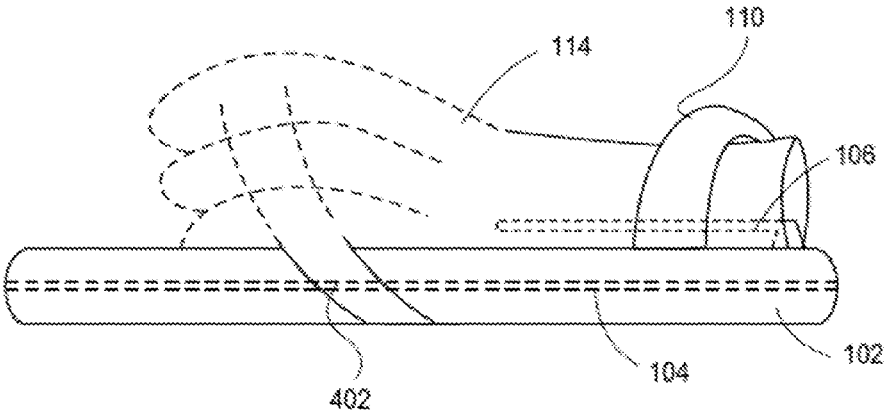
FIG. 10 shows a side view of the embodiment illustrated in FIG. 9.

For example, as shown in FIG. 10, the glove 114 or player's hand is able to grip the DCR 400 without the need of a full gripping surface, such as the gripping surface 106 shown in FIGS. 3-4. Instead, the glove 114 and player's hand may be secured with a wrist strap 110 at the base of frame 102 and the player's hand extends to hold or grip gripping bar 402. The arch or separation of the gripping bar 402 may be configured such that the player's hand is suspended a sufficient distance above the string bed 104 and avoids contact with the string bed 104, e.g., during ball impact.

Figure 11A:
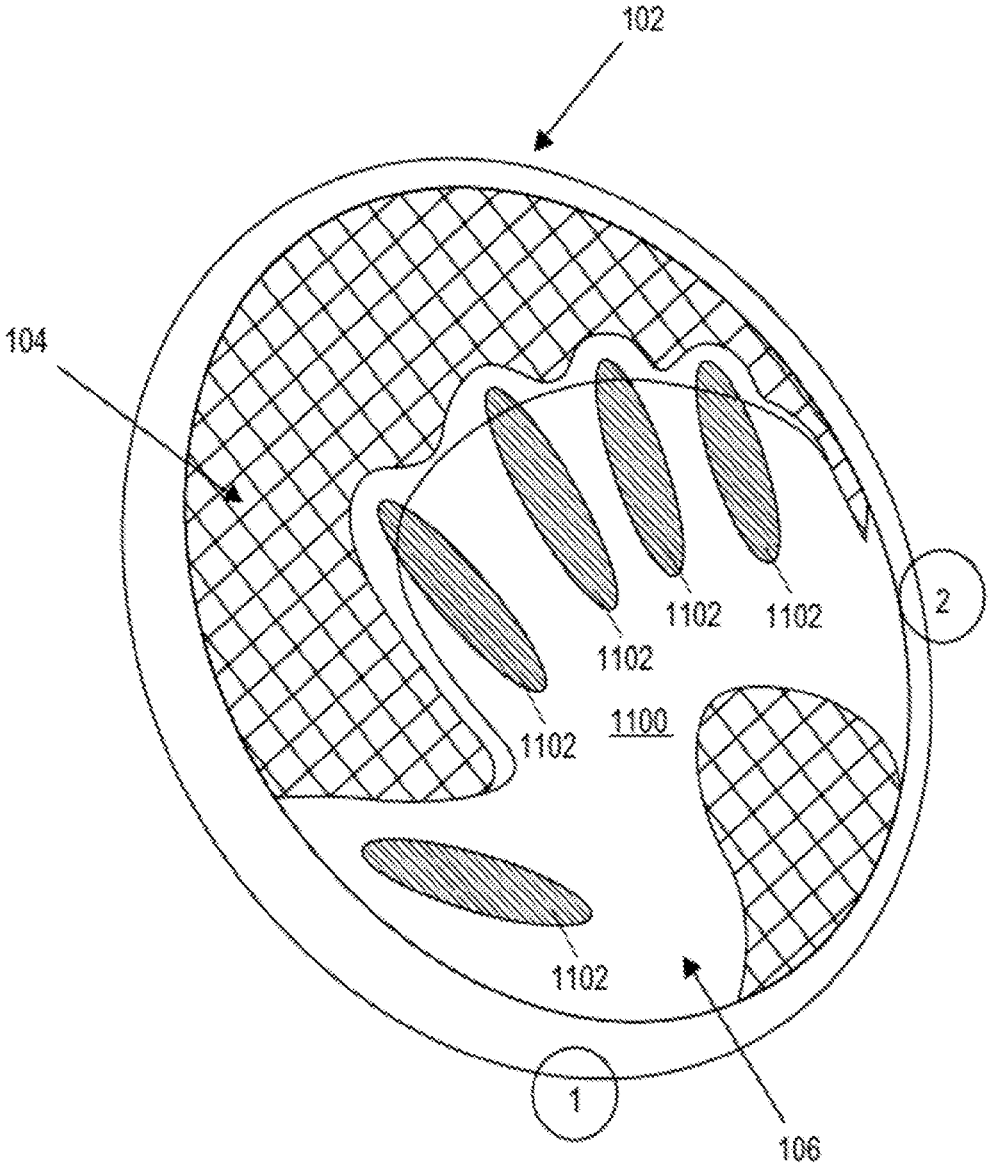
FIG. 11A shows a fifth embodiment of a direct contact racquet.

FIG. 11A shows a fifth embodiment of a direct contact racquet. In this embodiment, the gripping surface 106 may comprise a gripping bar 1100 that is a shaped piece that is attached to the frame 102 at two locations and generally spans across the frame 102 on the opposite side of the strike surface. The gripping bar 1100 may be configured with a curve that is convex to the string bed 104 to provide a sufficient clearance for deflection of the string bed 104 during contact with a ball.

As shown, the gripping bar 1100 may generally comprise a curved structure to accommodate the shape of a player's hand and have sufficient width to allow a player to rest the majority of their hand. As also shown, the gripping bar 1100 may comprise holes or slots 1102 to accommodate the fingers of a player's hand, with or without a glove.

Figure 11B:
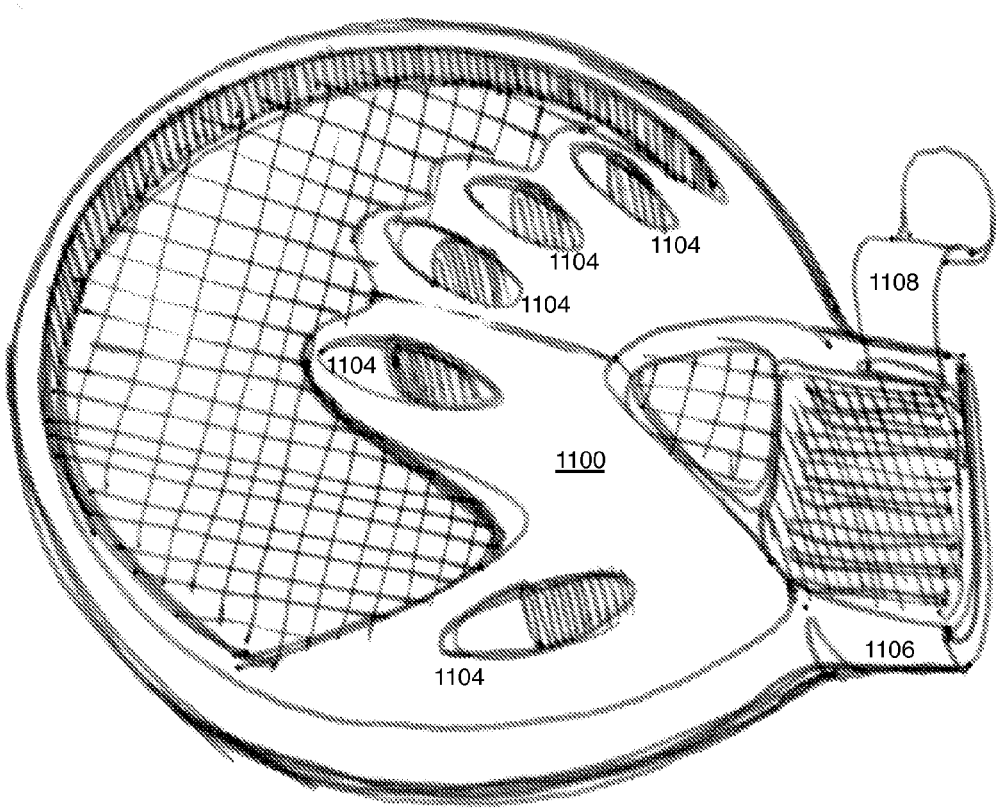
FIG. 11B shows another embodiment of the direct contact racquet.

FIG. 11B shows an embodiment of a direct contact racquet that is similar to the embodiment shown in FIG. 11A. In particular, in this embodiment, the gripping surface 106 may again comprise a gripping bar 1100 that is a shaped piece that is attached to the frame 102 at two locations and generally spans across the frame 102 on the opposite side of the strike surface. As also shown, in this embodiment, the gripping bar 110 may also comprise a cutout rather than a resting surface for the palm of the player's hand. Of course, the gripping bar 110 may provide a surface or cushion upon which the player may rest the palm of their hand.

In addition, in this embodiment, finger caps 1104 are provided on the gripping bar 1100 to accommodate the fingers of the player. Furthermore, a wrist groove 1106 and wrist strap 1108 may be provided to accommodate and secure a player's wrist to the direct contact racquet. Although one strap is shown, any number of straps may be provided.

Figure 11C:
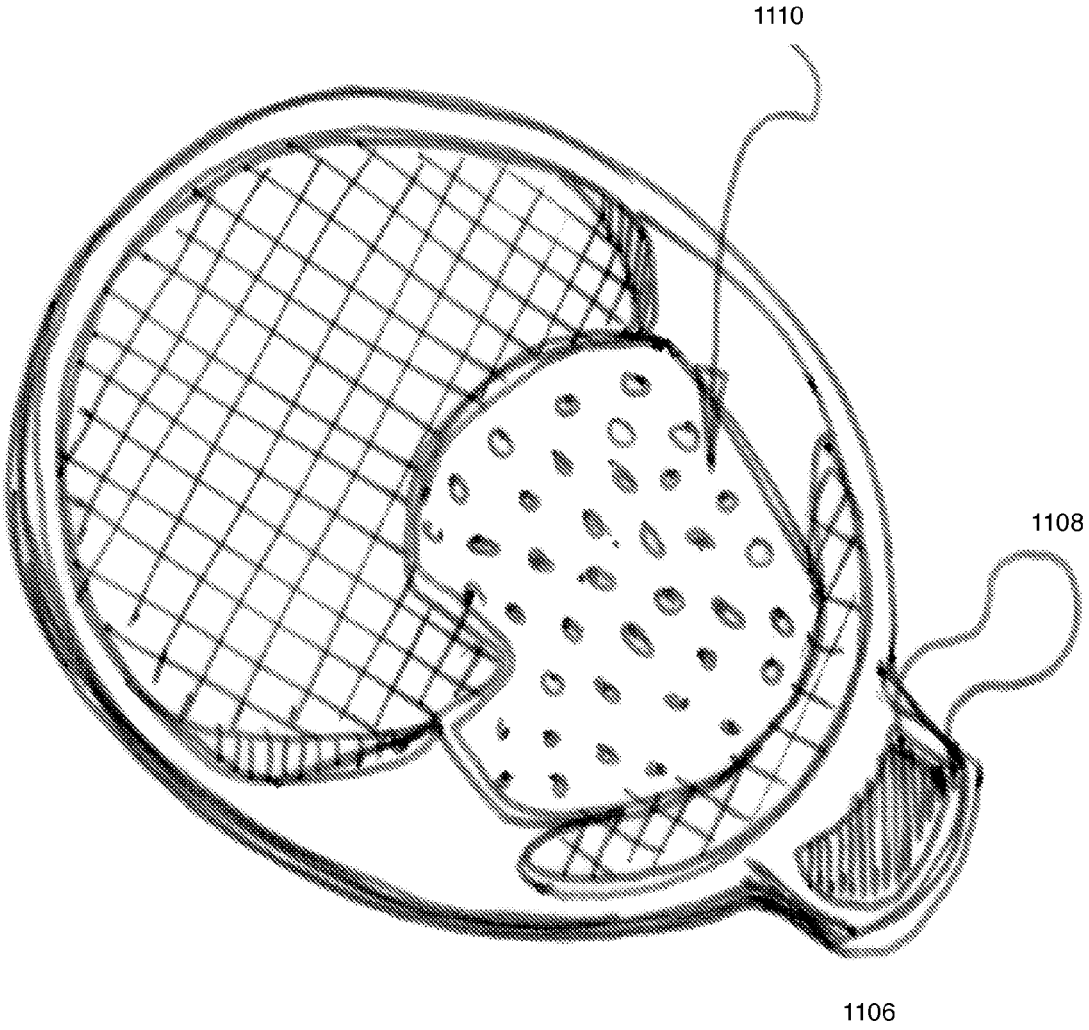
FIG. 11C shows another embodiment of the direct contact racquet.

FIG. 11C shows another embodiment of a direct contact racquet that is similar to the embodiment shown in FIGS. 11A-B. In this embodiment, the gripping surface 106 may again comprise a gripping bar 1100 that is a shaped piece that is attached to the frame 102 at two locations and generally spans across the frame 102 on the opposite side of the strike surface. As also shown, in this embodiment, the direct contact racquet may comprise a wrist groove 1106 and wrist strap 1108.

Furthermore, the gripping surface 106 may comprise a perforated member 1110. The member 1110 may be perforated with holes of various sizes, for example, to accommodate attachments to secure the player's hand, such as laces, loops, pedestals, etc. Such attachment features are also shown with reference to FIGS. 29-37 below.

The perforated member 1110 may be constructed from various materials, such as metal, wood, plastic, etc. In addition, the perforated member 1110 may comprise cushioning, such as a rubber, foam, leather, gel, etc. to provide comfort. The perforated member 1110 may be an integral piece of the gripping surface 106 or may be a detachable component of the gripping surface.

Figure 12:
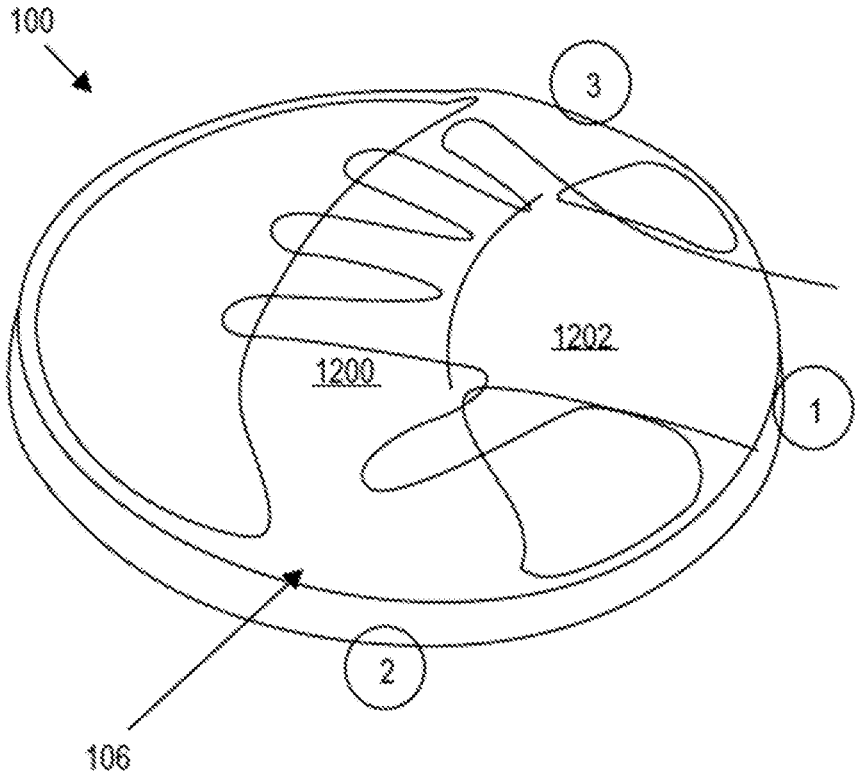
FIG. 12 shows a sixth embodiment of a direct contact racquet.

FIG. 12 shows a sixth embodiment of a direct contact racquet. In this embodiment, the gripping surface 106 may comprise a gripping bar 1200 and a wrist bar 1202. Thus, in this embodiment, the gripping surface 106 is attached to the frame 104 at three locations and generally spans across the width of frame 102. The gripping bar 1200 may be a curved member that is sufficiently wide enough to allow a player to rest their fingers on the gripping bar 1200. The gripping bar 1200 may comprise various features, such as holes or slots, for the player's fingers to assist in gripping. Alternatively, the player may employ a glove that attaches to the gripping bar, for example, with Velcro or other known attachment mechanism.

The wrist bar 1202 provides a resting surface for the player's palm and wrist. The wrist bar 1202 may be shaped in various ways to provide for comfort and assist in attaching a player's hand to the DCR 100. For example, the wrist bar 1202 may comprise a groove that fits around the player's wrist. In addition, the wrist bar 1202 may comprise one or more cushions for the player's palm and wrist. Furthermore, the wrist bar 1202 may be provided one or more straps (not shown) that wrap around the player's hand and/or wrist.

Figure 13:
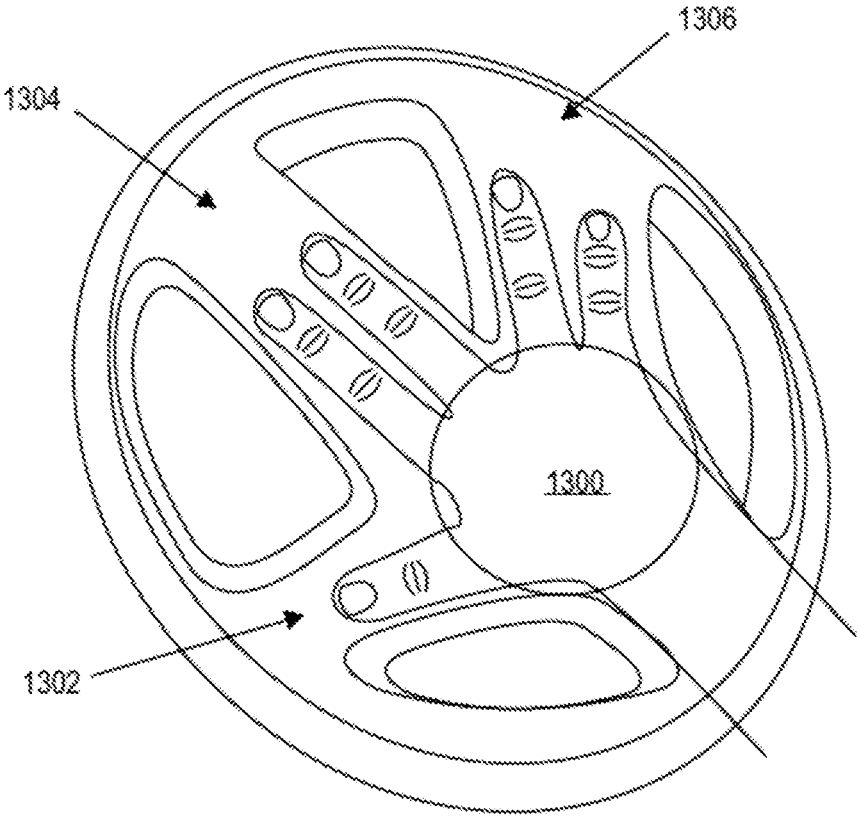
FIG. 13 shows a seventh embodiment of a direct contact racquet.

FIG. 13 shows a seventh embodiment of a direct contact racquet. In this embodiment, the gripping surface 106 may comprise a palm surface 1300 and three finger extensions 1302, 1304, and 1306. Accordingly, in this embodiment, the gripping surface 106 attaches to the frame 102 at three locations.

The palm surface 1300 provides a resting surface for a player's hand and provides structural support for the finger extensions 1302, 1304, and 1306. The palm surface 130 may comprise various features, such as a cushion, or Velcro, to assist in comfort and attachment of the player's hand, with or without a glove.

Finger extension 1302 provides a resting structure for a player's thumb. Finger extension 1304 may provide a resting structure for a player's index and middle fingers. Finger extension 1306 may provide a resting structure for a player's ring finger and pinky finger. The finger extensions 1302, 1304, and 1306 may comprise various features for attaching a player's finger. For example, finger extensions 1302, 1304, and 1306 may comprise holes or slots (not shown) for holding a player's fingers. Alternatively, the player's hand may be attached to the gripping surface 106 in various ways. FIGS. 29-38 provide various examples of attachment mechanisms and are further described below.

Figure 14:
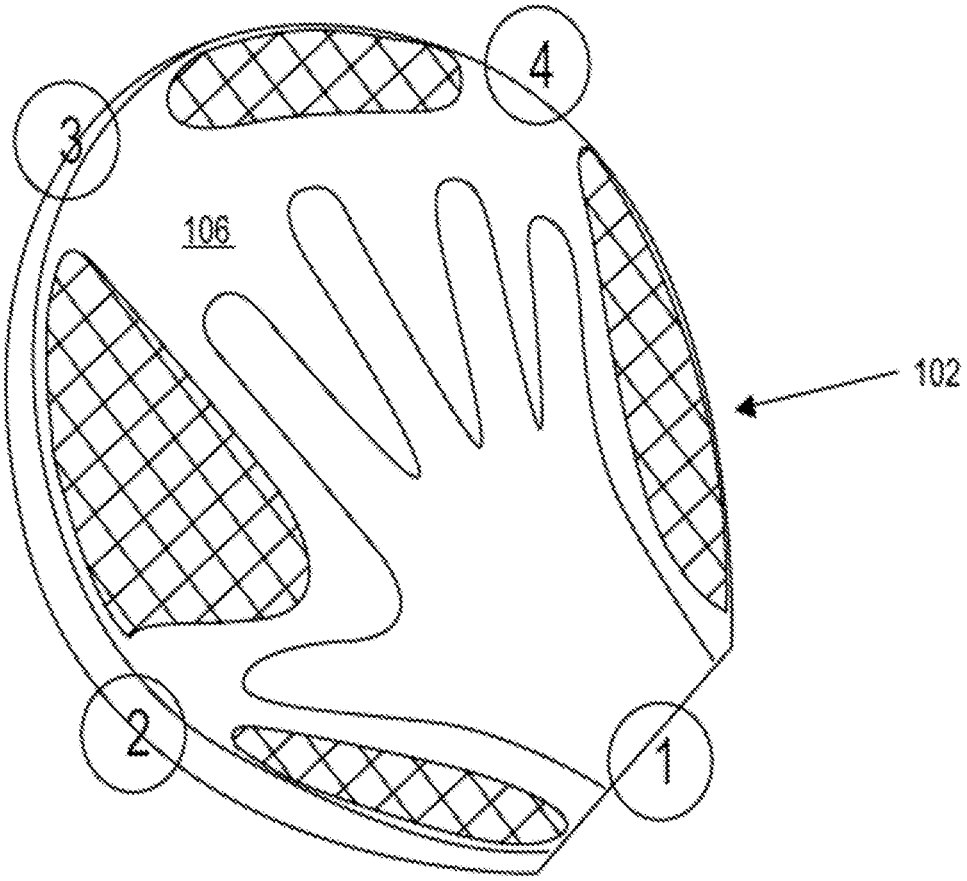
FIG. 14 shows an eight embodiment of a direct contact racquet.

FIG. 14 shows an eighth embodiment of a direct contact racquet. In this embodiment, the gripping surface 106 spans across the frame 102 and attaches to the frame 102 at four locations. In particular, the gripping surface 106 may attach to the frame at four locations that are spaced around the perimeter of the frame 102. In addition, the gripping surface 106 may comprise various features for attaching a player's finger. For example, the gripping surface 106 may comprise holes or slots (not shown) for holding a player's fingers. Alternatively, the player's hand may be attached to the gripping surface 106 in various ways. FIGS. 29-38 provide various examples of attachment mechanisms and are further described below.

Figure 15:
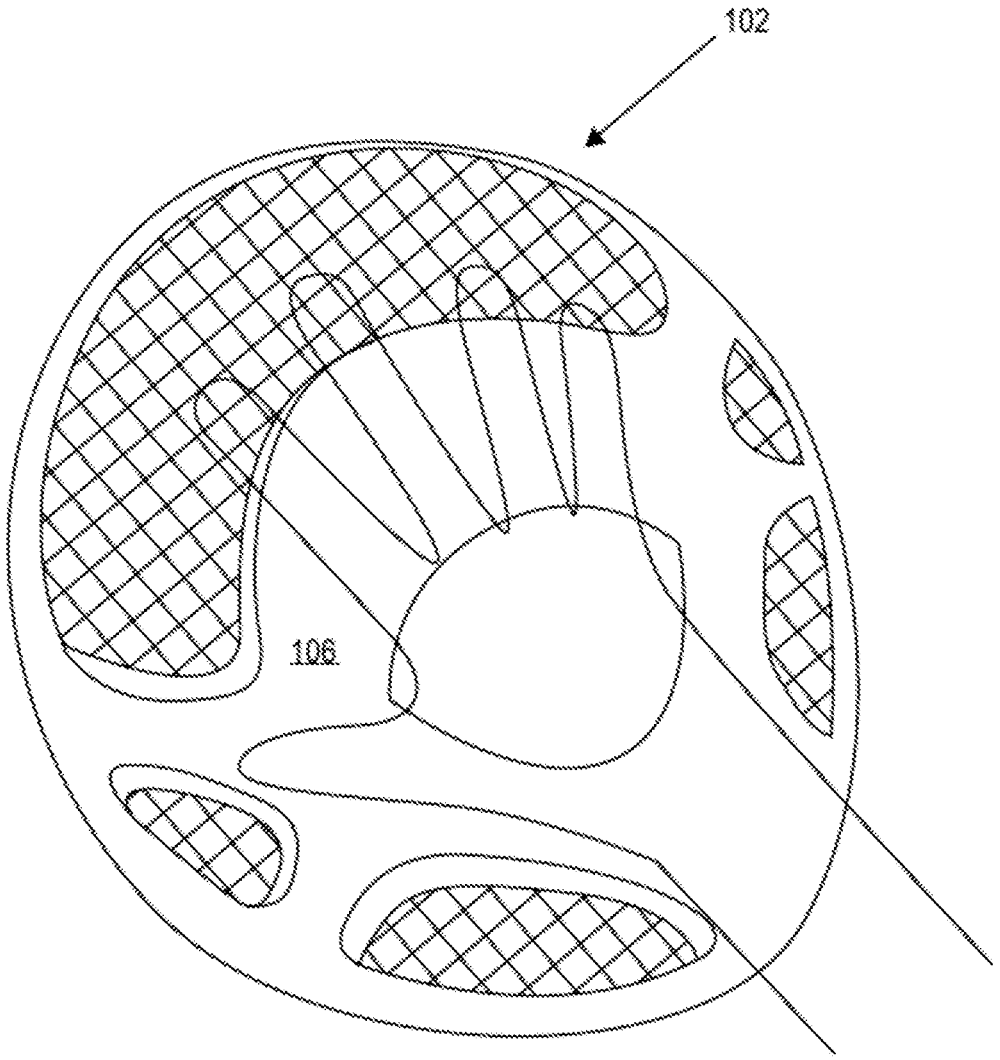
FIG. 15 shows a ninth embodiment of a direct contact racquet.

FIG. 15 shows a ninth embodiment of a direct contact racquet. In this embodiment, the gripping surface 106 spans across the frame 102 and attaches to the frame 102 at five locations. In particular, the gripping surface 106 may attach to the frame at four locations on opposing sides of the frame 102 and at a fifth location at or near the bottom of the frame 102. In addition, the gripping surface 106 may comprise various features for attaching a player's finger. For example, the gripping surface 106 may comprise holes or slots (not shown) for holding a player's fingers. Alternatively, the player's hand may be attached to the gripping surface 106 in various ways. FIGS. 29-38 provide various examples of attachment mechanisms and are further described below.

Figure 16:
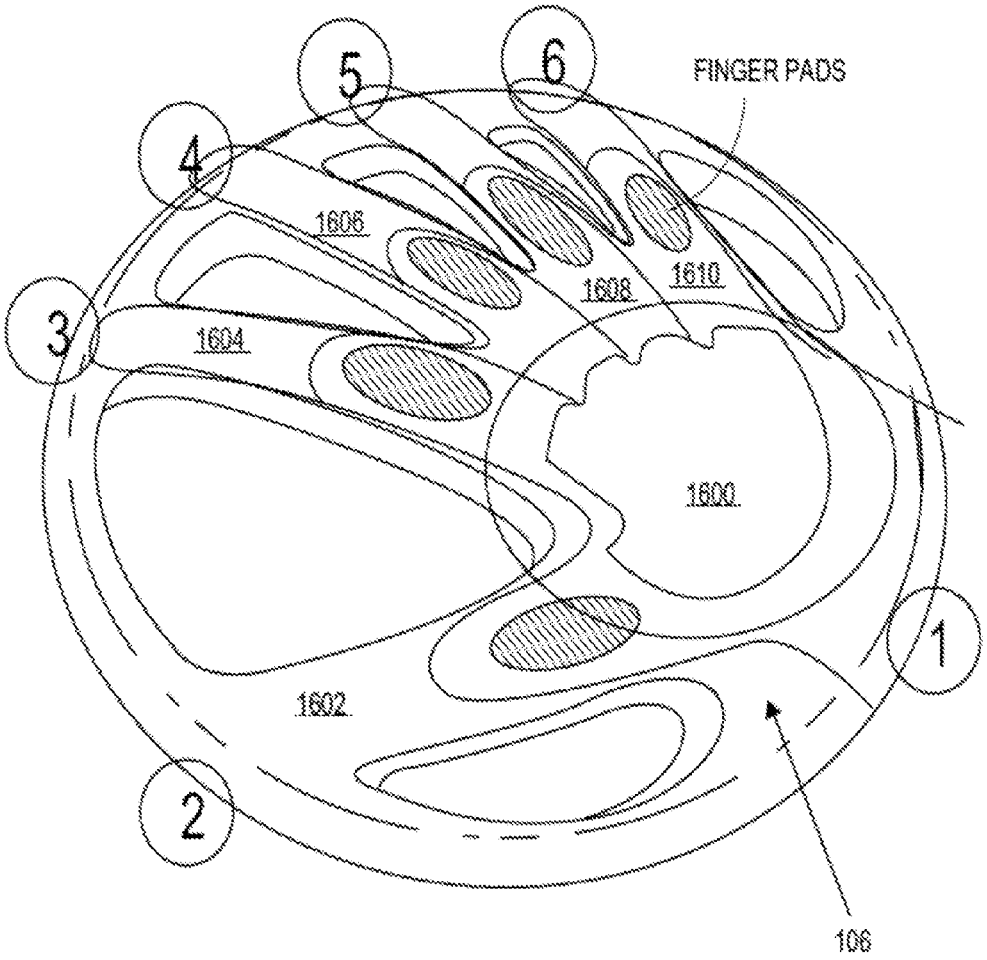
FIG. 16 shows a tenth embodiment of a direct contact racquet.

FIG. 16 shows a tenth embodiment of a direct contact racquet. In this embodiment, the gripping surface 106 is configured with a palm surface 1600 and finger extensions 1602, 1604, 1606, 1608, and 1610 for individual fingers of the player's hand. As shown, the palm surface 1600 is attached to the frame 102 and provides a resting surface for the player's palm and/or wrist. The palm surface 1600 may comprise various features, such as a cushion and Velcro, to provide comfort and assist in attaching the player's hand.

Finger extensions 1602, 1604, 1606, 1608, and 1610 provide a resting structure for individual fingers of the player. As shown, in one embodiment, the finger extensions 1602, 1604, 1606, 1608, and 1610 may extend from the palm surface 1600 and attach at respective locations on frame 102. In one embodiment, the finger extensions 1602, 1604, 1606, 1608, and 1610 may comprise pads or cushions for the player's fingers. In addition, the finger extensions 1602, 1604, 1606, 1608, and 1610 may comprise various features for attaching a player's finger. For example, the finger extensions 1602, 1604, 1606, 1608, and 1610 may comprise holes or slots (not shown) for holding a player's fingers. Alternatively, the player's fingers may be attached to the finger extensions 1602, 1604, 1606, 1608, and 1610 in various ways. FIGS. 29-38 provide various examples of attachment mechanisms and are further described below.

Figure 17:
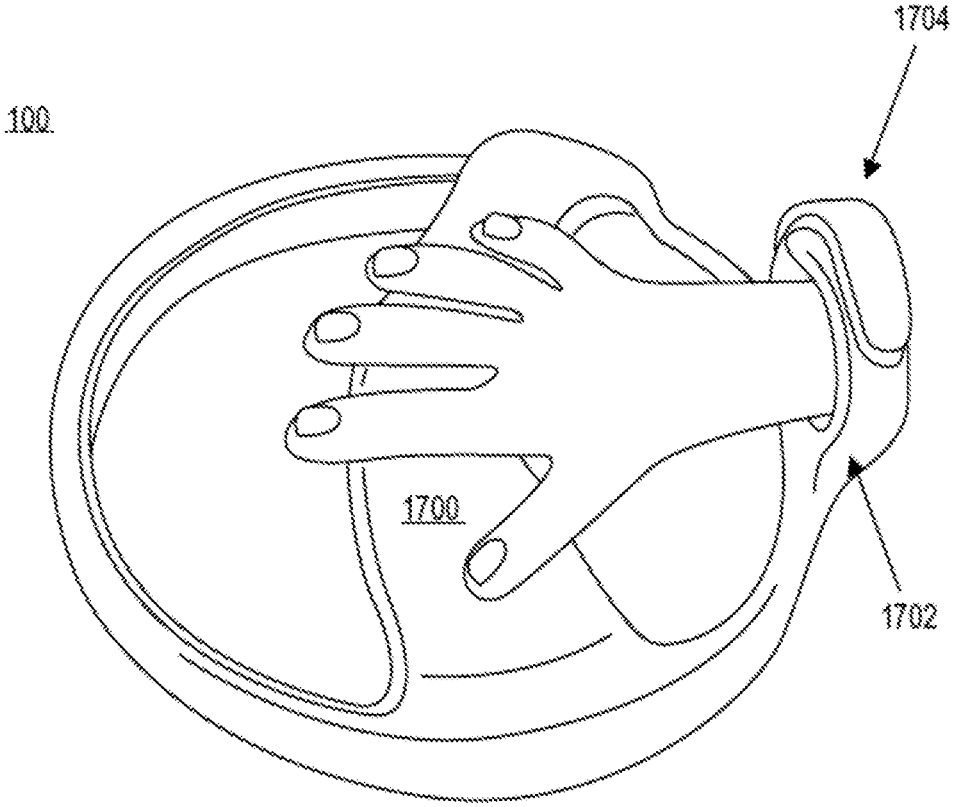
FIG. 17 shows a twelfth embodiment of a direct contact racquet.

FIG. 17 shows a twelfth embodiment of a direct contact racquet. In this embodiment, the DCR 100 may comprise a gripping bar 1700 that spans across the width of the frame 102. The gripping bar 1700 may be similar to the various gripping bars described above. The player's hand may be attached to gripping bar 1700 in various ways. FIGS. 29-38 provide various examples of attachment mechanisms and are further described below.

In addition, the frame 104 may comprise a wrist pad 1702 for accommodating the player's wrist. The wrist pad 1702 may extend from the frame 102 and may have variety of lengths to accommodate the player's wrist and/or arm. A strap 1704 may also be provided on the wrist pad 1702. Any number of straps may be provided on the wrist pad 1702 depending on its length.

Figure 18:
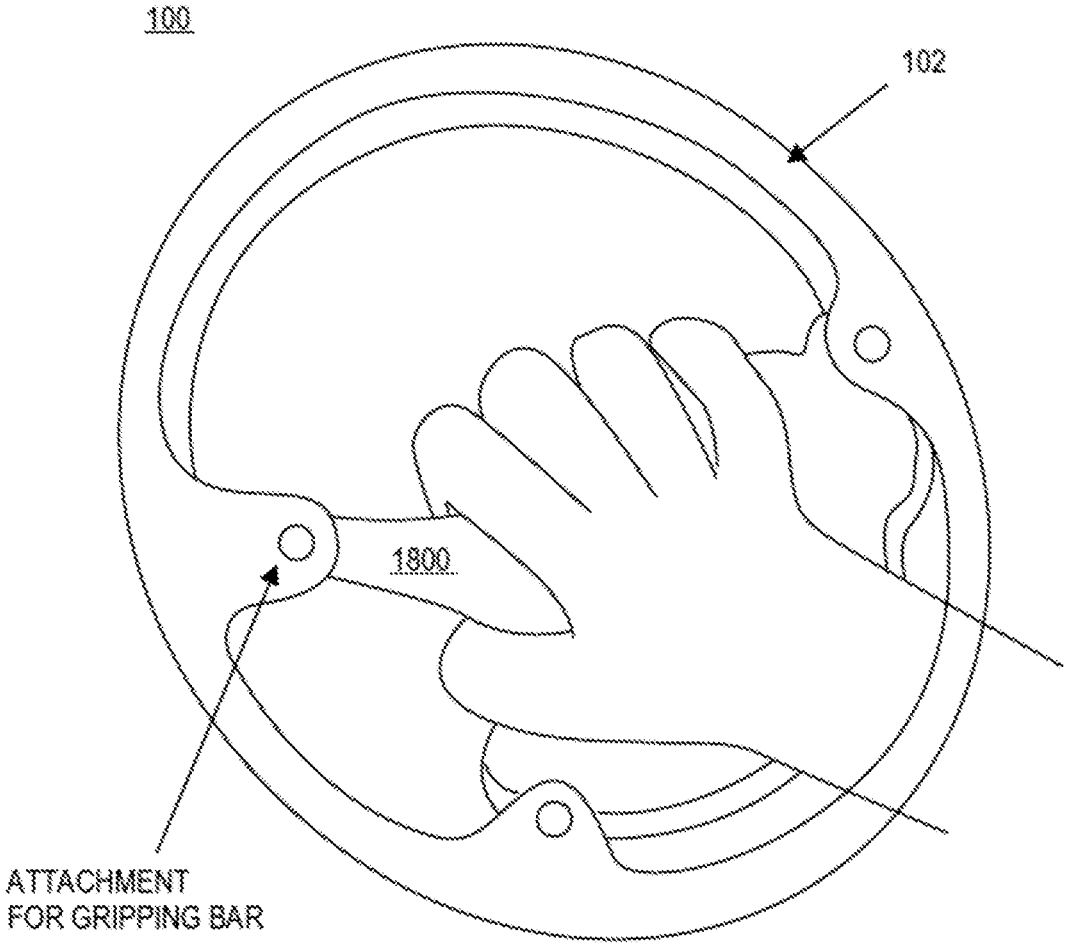
FIG. 18 shows a thirteenth embodiment of a direct contact racquet.

FIG. 18 shows a thirteenth embodiment of a direct contact racquet. In this embodiment, the DCR 100 comprises a gripping bar 1800 that attaches to various locations on the frame 102. For example, as shown, the gripping bar 1800 may attach to three locations on the frame 102. In this embodiment, the gripping bar 1800 may be ergonomically shaped such that a player may grip or close their fingers around the gripping bar 1800. As shown, the gripping bar 1800 may be detachable from the frame 102.

In addition, the gripping bar 1800 may comprise various features, such as a cushion, slots, and the like, to provide for comfort and attachment of the player's hand, with or without a glove. The player's hand may be attached to gripping bar 1800 in various ways. FIGS. 29-38 provide various examples of attachment mechanisms and are further described below.

Figure 19A:
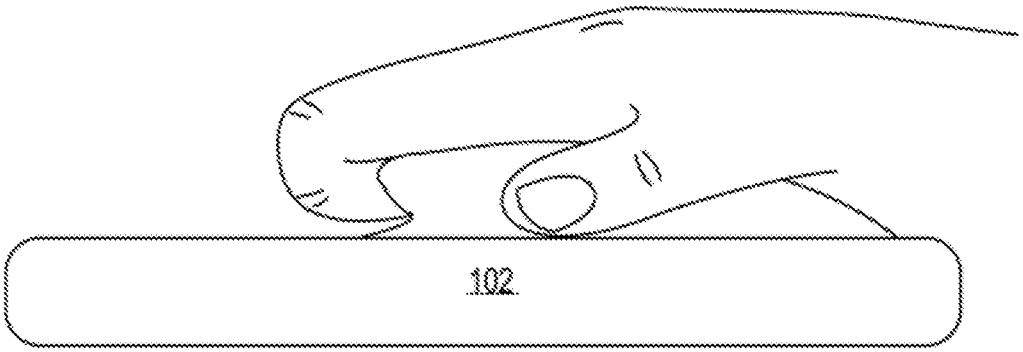
FIGS. 19A-19B show a fourteenth embodiment of a direct contact racquet.
Figure 19B:
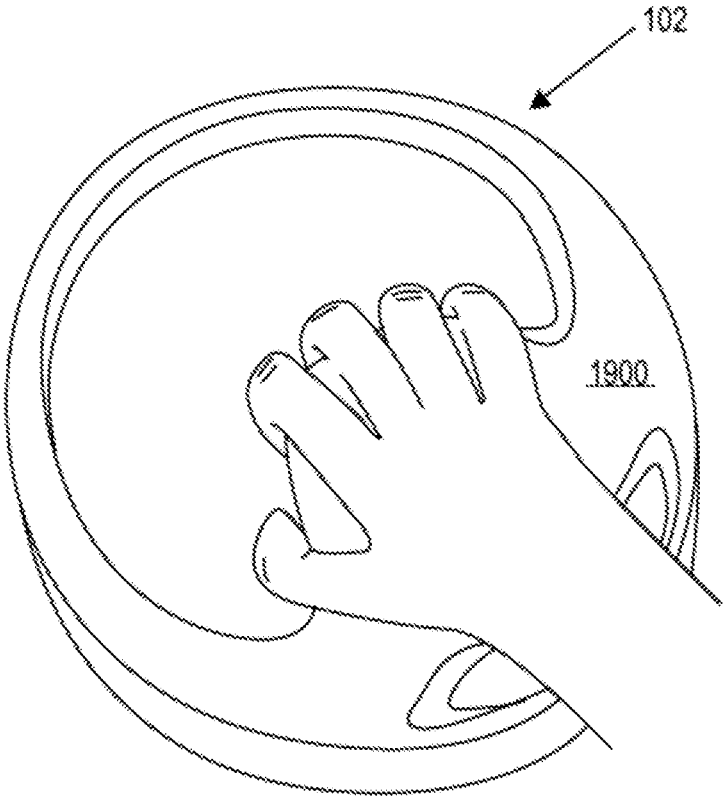

FIGS. 19A-19B show a fourteenth embodiment of a direct contact racquet. In particular, FIG. 19A shows a side view and FIG. 19B shows a top, perspective view. In this embodiment, the DCR 100 may again comprise a gripping bar 1900. As shown, the gripping bar 1900 may attach to the frame 102 at two locations on opposing sides. The gripping bar 1900 may be an integral part of the frame 102 or may be a detachable piece. In similar fashion to the gripping bar shown in FIG. 18, the gripping bar 1900 may be ergonomically shaped such that a player may grip or close their fingers around the gripping bar 1900. The gripping bar 1900 may comprise various features, such as a cushion, slots, and the like, to provide for comfort and attachment of the player's hand, with or without a glove.

Figure 20:
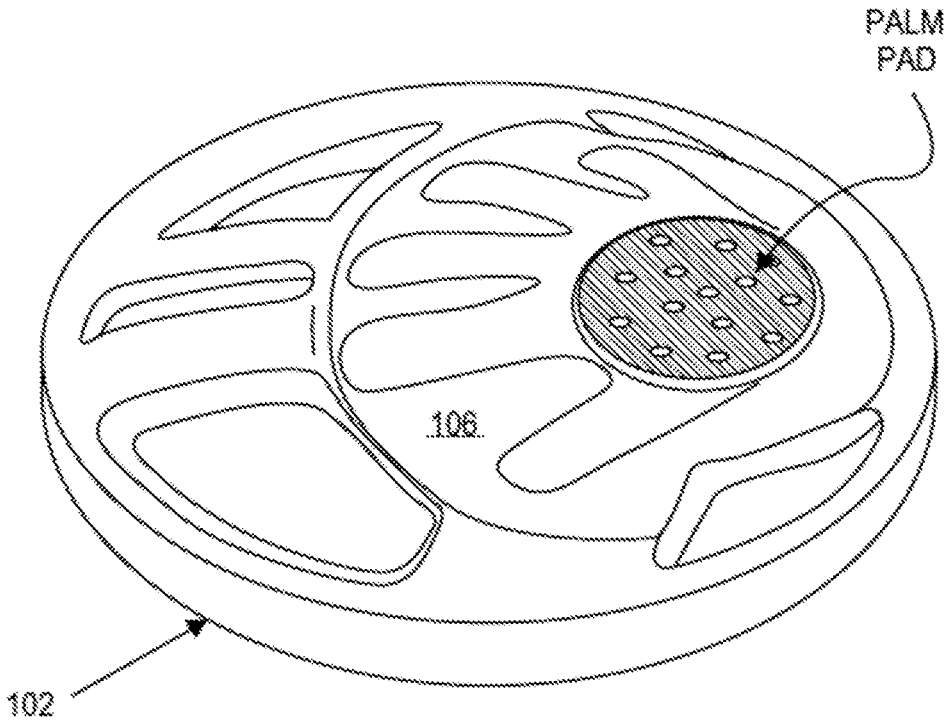
FIGS. 20 and 21 show a fifteenth embodiment of a direct contact racquet.
Figure 21:
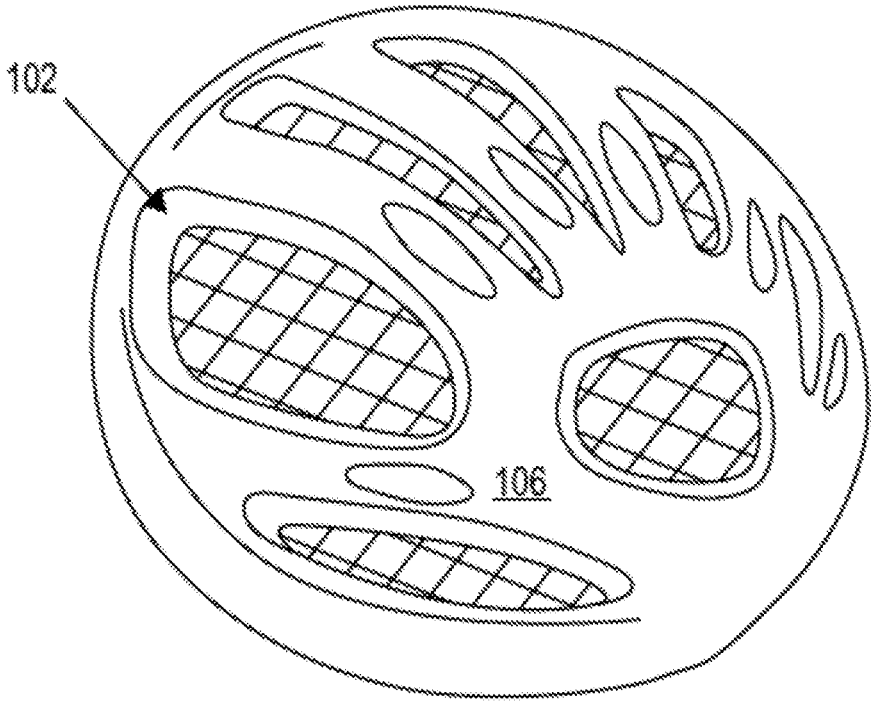

FIGS. 20 and 21 show a fifteenth embodiment of a direct contact racquet. In this embodiment, the gripping surface 106 is sized to accommodate the player's hand. The player's hand may be attached in various ways. FIGS. 29-38 provide various examples of attachment mechanisms and are further described below. As shown, the gripping surface 106 may attach to the frame 102 at four locations.

The gripping surface 106 may comprise various features for comfort and attachment. For example, the gripping surface 106 may comprise a palm pad or cushion 2000. In addition, the gripping surface 106 may provide a surface for accommodating the player's wrist. The gripping surface 106 may comprise a groove or slot (not shown) for conforming to the player's wrist and/or arm. Furthermore, the gripping surface 106 may comprise one or more straps (not shown) to attach the player's hand to the gripping surface 106.

Figure 22A:
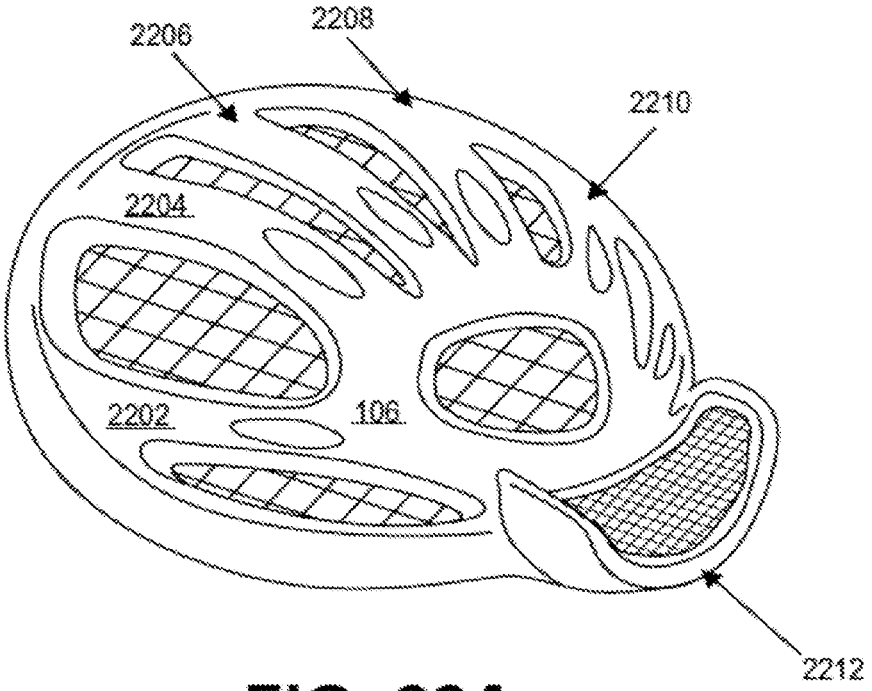
FIGS. 22A-22C show a sixteenth embodiment of a direct contact racquet.
Figure 22B:
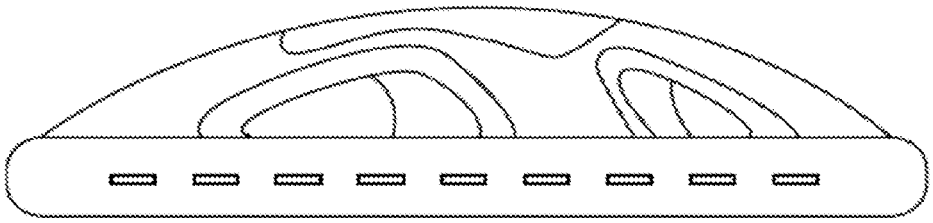
Figure 22C:
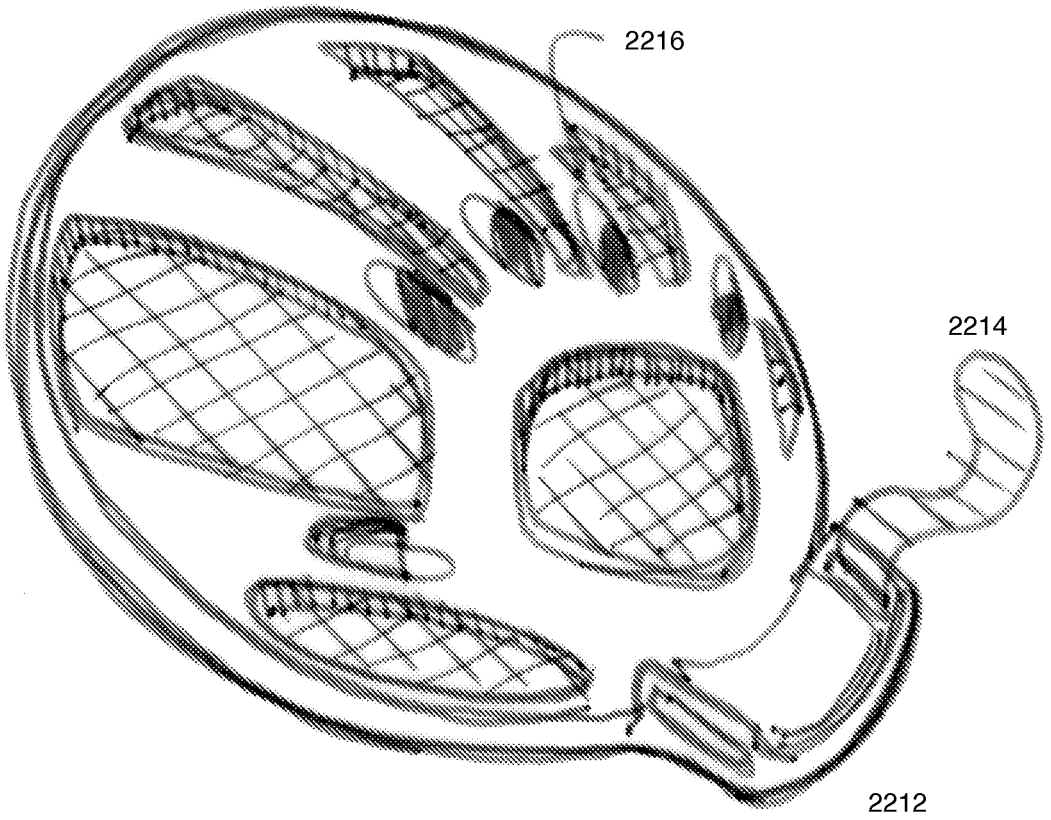

FIGS. 22A-22C show a sixteenth embodiment of a direct contact racquet. In particular, FIGS. 22A and 22C show a top, perspective view and FIG. 22B shows a side view. In this embodiment, the gripping surface 106 is configured with a palm surface 2200 and finger extensions 2202, 2204, 2206, 2208, and 2210 for individual fingers of the player's hand. As shown, the palm surface 2200 is attached to the frame 102 and provides a resting surface for the player's palm and/or wrist. In this embodiment, the palm surface 2200 comprises a cutout.

Finger extensions 2202, 2204, 2206, 2208, and 2210 provide a resting structure for individual fingers of the player. As shown, in one embodiment, the finger extensions 2202, 2204, 2206, 2208, and 2210 may extend from the palm surface 2200 and attach at respective locations on frame 102. In one embodiment, the finger extensions 2202, 2204, 2206, 2208, and 2210 may comprise pads or cushions for the player's fingers. In addition, the finger extensions 2202, 2204, 2206, 2208, and 2210 may comprise various features for attaching a player's finger. For example, the finger extensions 2202, 2204, 2206, 2208, and 2210 may comprise holes or slots (not shown) for holding a player's fingers. Alternatively, the player's fingers may be attached to the finger extensions 2202, 2204, 2206, 2208, and 2210 in various ways. FIGS. 29-38 provide various examples of attachment mechanisms and are further described below.

In addition, the frame 102 may comprise a wrist groove 2212 for accommodating the player's wrist. The wrist groove 2212 may extend from the frame 102 and may have variety of lengths to accommodate the player's wrist and/or arm. As shown, the wrist groove 2212 may comprise a cushion for providing comfort to the player's wrist and/or arm.

A strap 2214 (as shown in FIG. 22C) may also be provided on the wrist groove 2212. Any number of straps may be provided on the wrist groove 2212 depending on its length. In addition, various finger caps or loops 2216 may be provided to secure the fingers of the player's hand.

Figure 23:
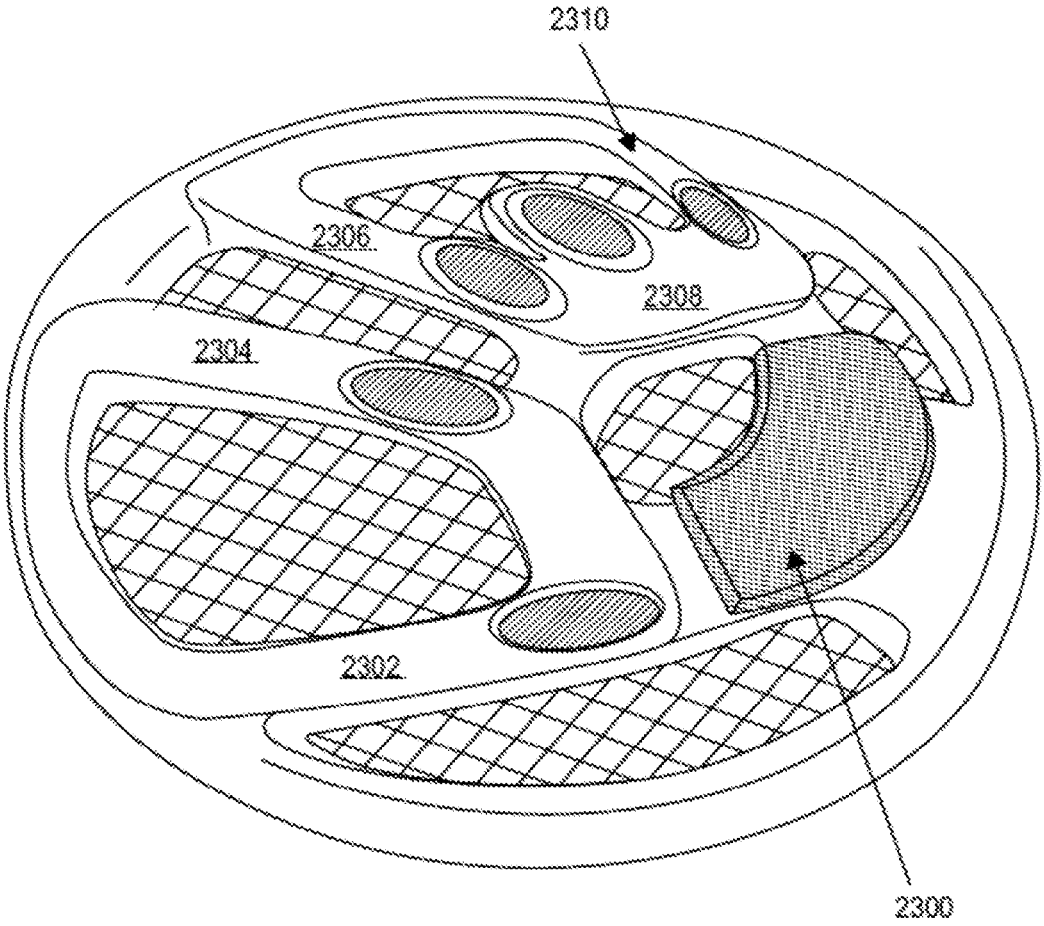
FIG. 23 shows a seventeenth embodiment of a direct contact racquet.

FIG. 23 shows a seventeenth embodiment of a direct contact racquet. In this embodiment, the gripping surface 106 is configured with a palm surface 2300 and finger extensions 2302, 2304, 2306, 2308, and 2310 for individual fingers of the player's hand. As shown, the palm surface 2300 is attached to the frame 102 and provides a resting surface for the player's palm and/or wrist. In this embodiment, the palm surface 2200 comprises a cutout and a cushion.

Finger extensions 2302, 2304, 2306, 2308, and 2310 provide a resting structure for individual fingers of the player and attach to the frame 102. Any number of the finger extensions may attach to the frame 102. For example, as shown, in one embodiment, the finger extensions 2302, 2304, 2306, and 2310 may extend from the palm surface 2200 and attach at respective locations on frame 102. In this embodiment, the finger extension 2308, i.e., for a player's ring finger does not attach to the frame 102.

In one embodiment, the finger extensions 2302, 2304, 2306, 2308, and 2310 may comprise pads or cushions for the player's fingers. In addition, the finger extensions 2302, 2304, 2306, 2308, and 2310 may comprise various features for attaching a player's finger. For example, the finger extensions 2302, 2304, 2306, 2308, and 2310 may comprise holes or slots (not shown) for holding a player's fingers. Alternatively, the player's fingers may be attached to the finger extensions 2302, 2304, 2306, 2308, and 2310 in various ways. FIGS. 29-38 provide various examples of attachment mechanisms and are further described below.

Figure 24:
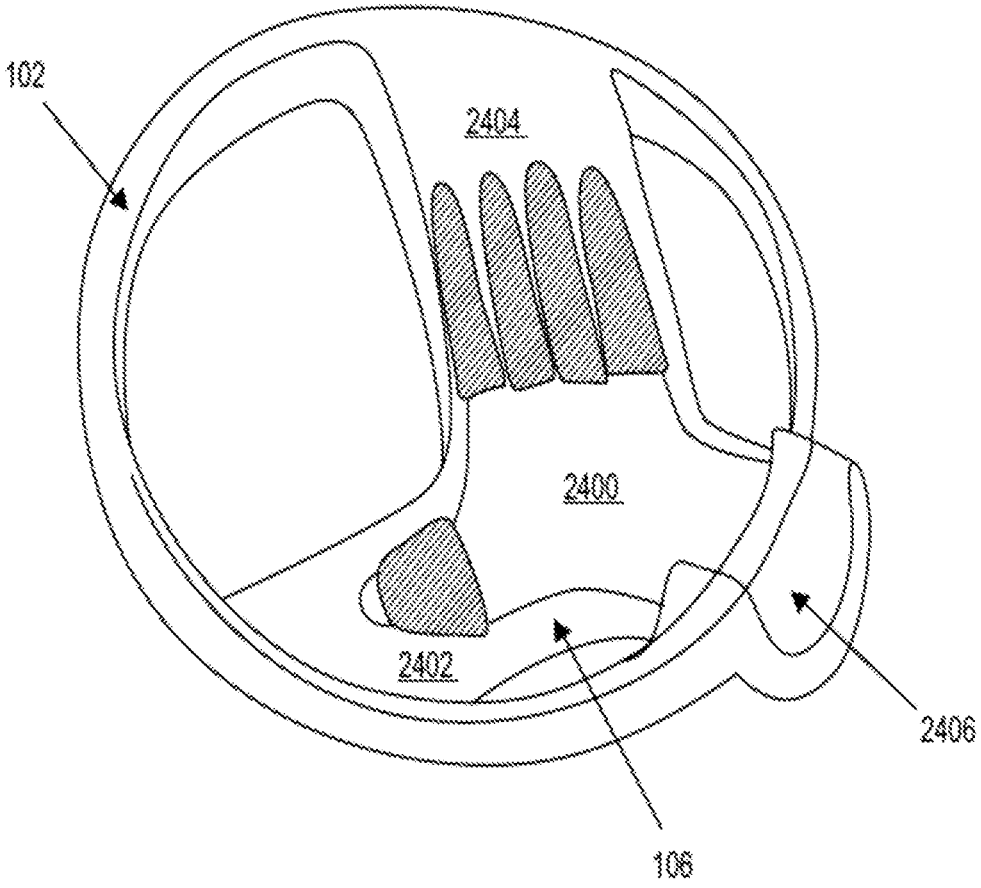
FIG. 24 shows an eighteenth embodiment of a direct contact racquet.

FIG. 24 shows an eighteenth embodiment of a direct contact racquet. In this embodiment, the gripping surface 106 is configured with a palm surface 2400 and extensions 2402 and 2404 for fingers of the player's hand. As shown, the palm surface 2200 is attached to the frame 102 and provides a resting surface for the player's palm and/or wrist.

As shown, the extension 2402 may extend at an angle from the palm surface 2400 to accommodate a player's thumb and attaches to the frame 102. Likewise, extension 2404 provides a resting structure for one or more of the other fingers of the player and also attaches to the frame 102. In one embodiment, the extensions 2402 and 2404 may comprise pads or cushions for the player's fingers. In addition, the extensions 2402 and 2404 may comprise various features for attaching a player's finger. For example, the extensions 2402 and 2404 may comprise holes or slots (not shown) for holding a player's fingers. Alternatively, the player's fingers may be attached to the extensions 2402 and 2404 in various ways. FIGS. 29-38 provide various examples of attachment mechanisms and are further described below.

In addition, the frame 102 may comprise a wrist groove 2406 for accommodating the player's wrist. The wrist groove 2406 may extend from the frame 102 and may have variety of lengths to accommodate the player's wrist and/or arm. The wrist groove 2212 may comprise a cushion for providing comfort to the player's wrist and/or arm. A strap may also be provided on the wrist groove 2406. Any number of straps may be provided on the wrist groove 2406 depending on its length.

Figure 25A:
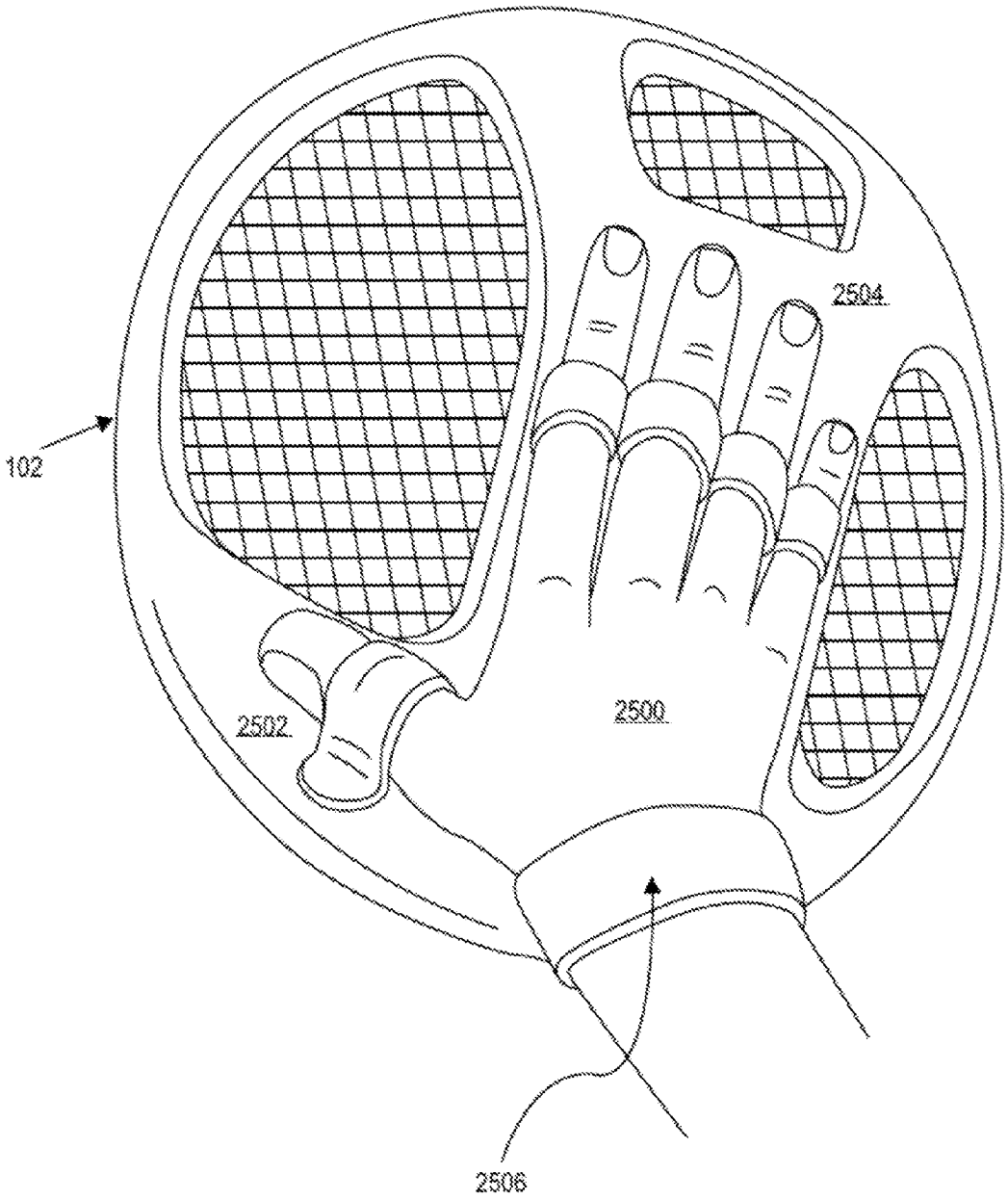
FIGS. 25A-B shows a nineteenth embodiment of a direct contact racquet.
Figure 25B:
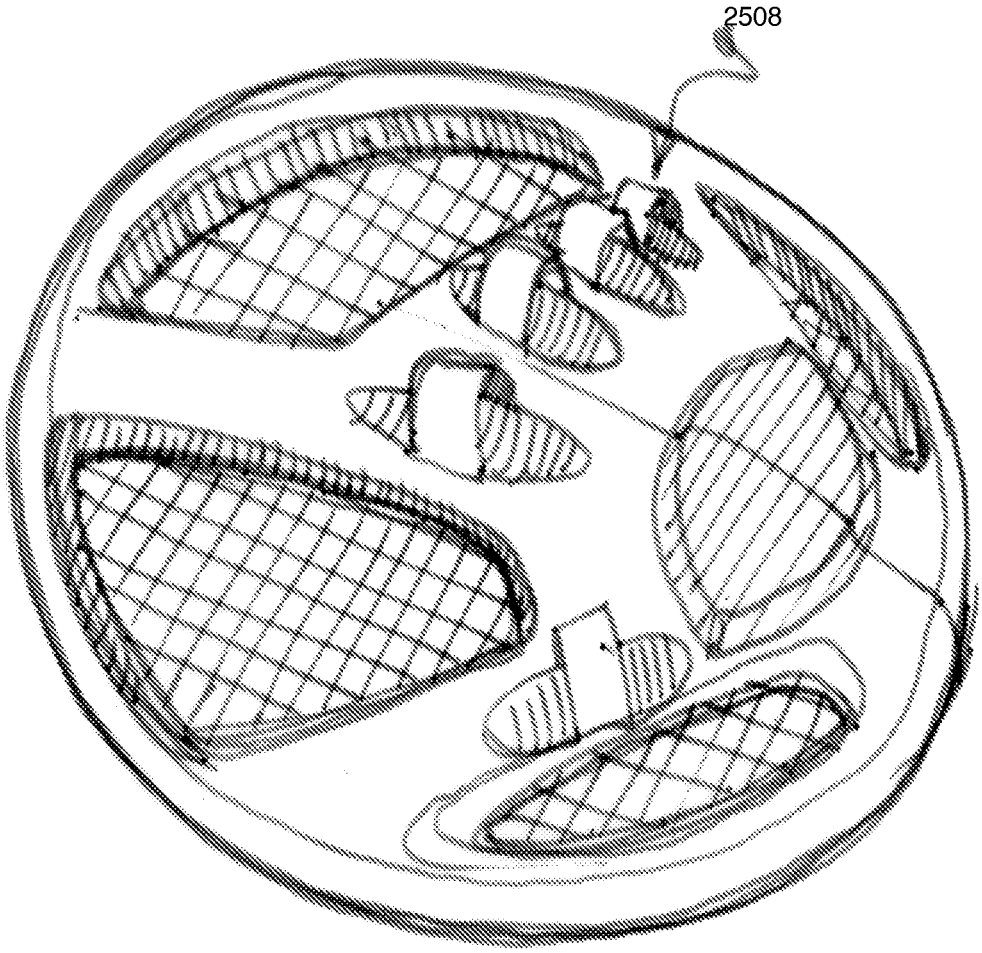

FIGS. 25A-B shows a nineteenth embodiment of a direct contact racquet. In this embodiment, the gripping surface 106 is similar to the embodiment shown in FIG. 24. In this embodiment, the gripping surface 106 is configured with a palm surface 2500 and extensions 2502 and 2504 for fingers of the player's hand. As shown, the palm surface 2500 is attached to the frame 102 and provides a resting surface for the player's palm and/or wrist. In addition, a wrist strap 2506 may be optionally provided.

As shown, the extension 2502 may extend at an angle from the palm surface 2500 to accommodate a player's thumb and extends from the frame 102. Likewise, extension 2504 provides a resting structure for one or more of the other fingers of the player and also attaches at two locations to the frame 102. In one embodiment, the extensions 2502 and 2504 may comprise pads or cushions for the player's fingers. In addition, the extensions 2502 and 2502 may comprise various features for attaching a player's finger. For example, the extensions 2502 and 2504 may comprise holes or slots (not shown) for holding a player's fingers. Alternatively, as shown in FIG. 25B, the player's fingers may be attached to the extensions 2502 and 2504 with straps or loops 2508. In the embodiment, shown in FIG. 25B, individual loops 2508 are provided for each individual finger. In other embodiments, any number of loops may be provided for one or more fingers alone or in combination. Furthermore, FIGS. 29-38 provide various other examples of attachment mechanisms and are further described below.

Figure 26:
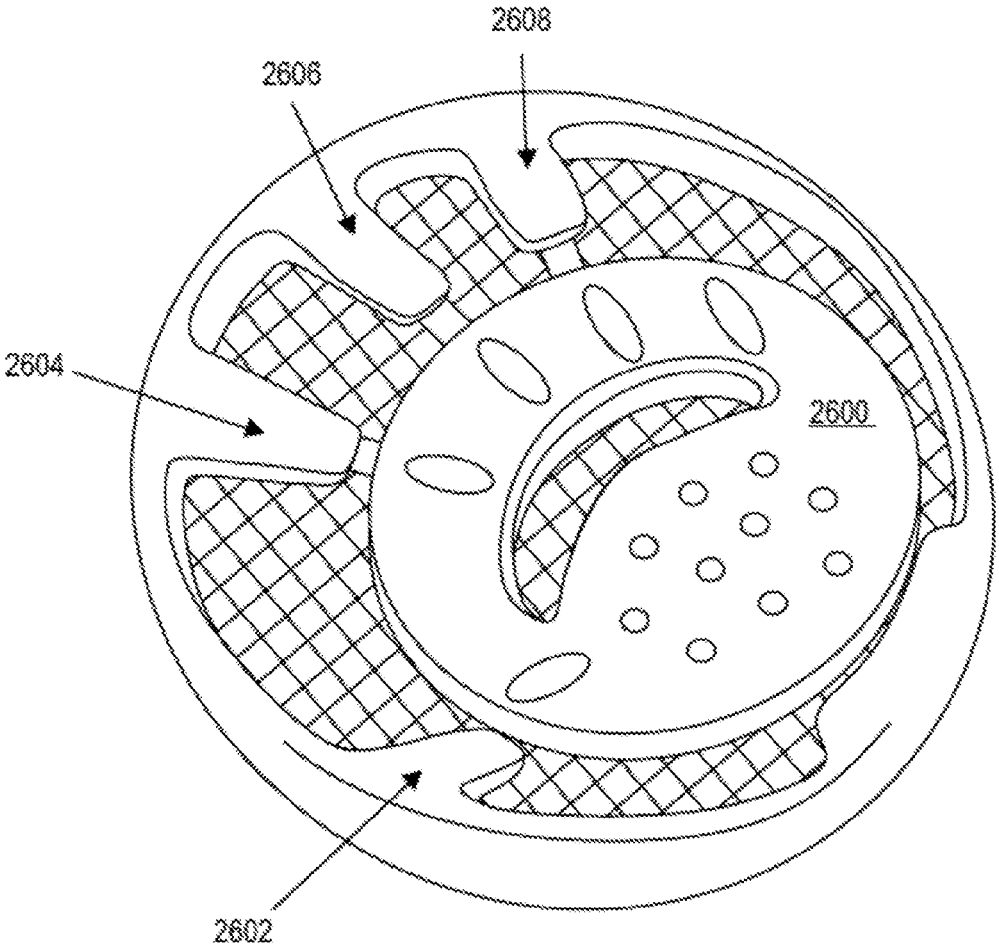
FIG. 26 shows a twentieth embodiment of a direct contact racquet.

FIG. 26 shows a twentieth embodiment of a direct contact racquet. In this embodiment, the gripping surface 106 is configured with a palm surface 2600 and connecting structures 2602, 2604, 2606, 2608, and 2610. As shown, the palm surface 2600 provides a resting surface for the player's palm and/or wrist and may comprise a cutout 2612 to accommodate the base of the player's fingers.

As shown, the connecting structures 2602, 2604, 2606, 2608, and 2610 are placed to be substantially inline with a player's thumb and fingers to provide structural support for the gripping structure 106. In one embodiment, as shown, the gripping surface 106 may comprise pads or cushions for the player's fingers. In addition, the gripping surface 106 comprises various features for attaching a player's finger. For example, the gripping surface 106 may comprise holes or slots (not shown) for holding a player's fingers. FIGS. 29-38 provide various examples of attachment mechanisms and are further described below.

Figure 27:
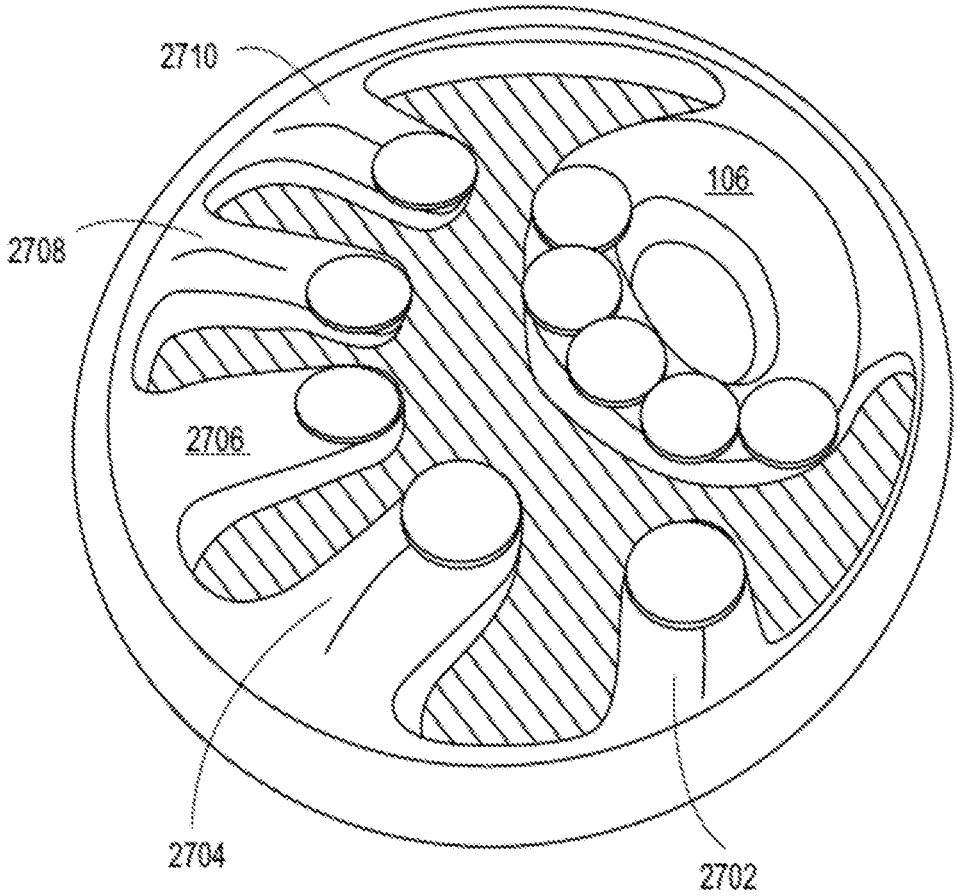
FIG. 27 shows a twenty-first embodiment of a direct contact racquet.

FIG. 27 shows a twenty-first embodiment of a direct contact racquet. In this embodiment, the gripping surface 106 provides a resting surface for the player's palm. As shown, in this embodiment, the gripping surface 106 comprises a cutout and cushions for the base of the player's fingers.

In addition, as shown, the frame 102 may comprise finger extensions 2702, 2704, 2706, 2708, and 2710 that provide a resting structure for the fingertips of the player's hand. In this embodiment, a gap is provided between the gripping surface 106 for the player's palm and finger extensions 2702, 2704, 2706, 2708, and 2710. Finger extensions 2702, 2704, 2706, 2708, and 2710 may comprise pads or cushions for the player's fingers. In addition, the finger extensions 2702, 2704, 2706, 2708, and 2710 may comprise various features for attaching a player's finger. For example, the finger extensions 2702, 2704, 2706, 2708, and 2710 may comprise holes or slots (not shown) for holding a player's fingers.

Figure 28A:
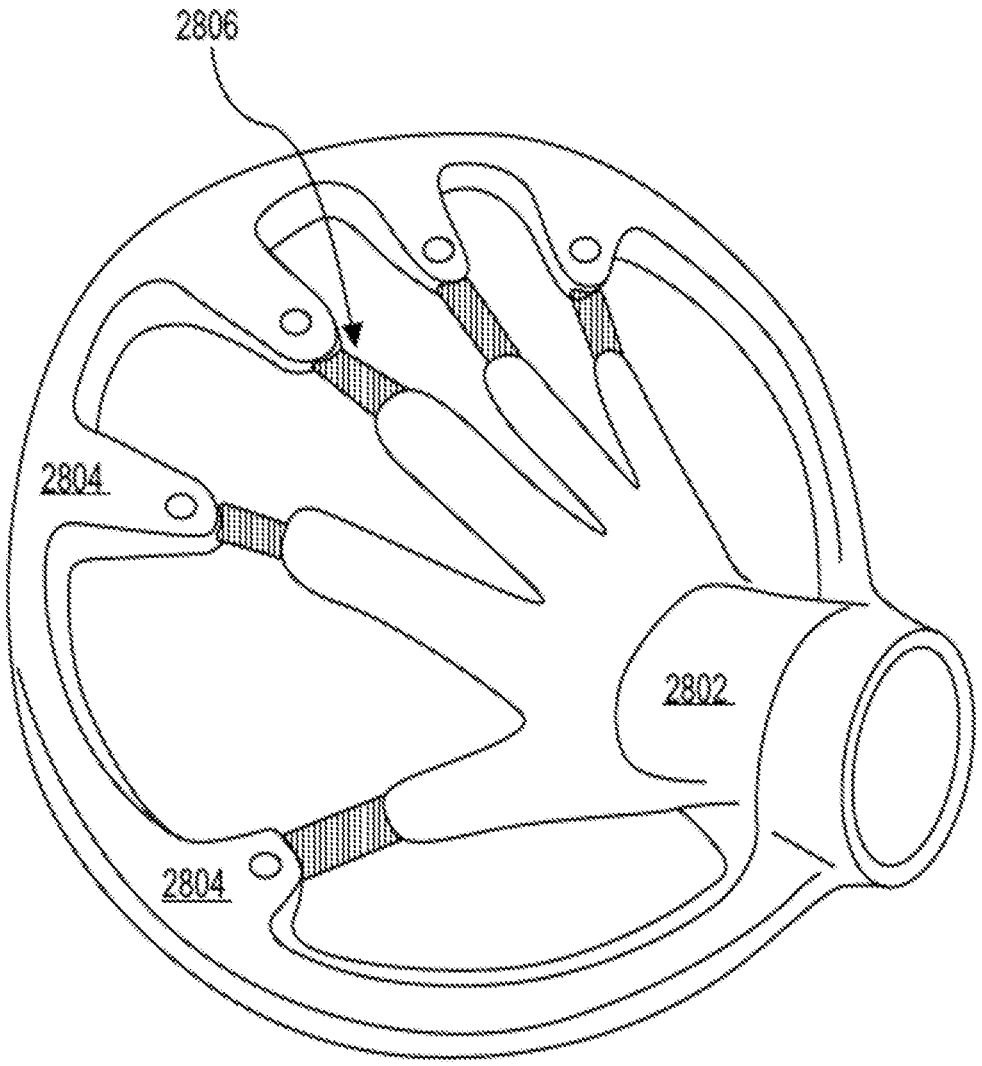
FIG. 28A shows a twenty-second embodiment of a direct contact racquet that employs a glove.

FIG. 28A shows a twenty-second embodiment of a direct contact racquet. In this embodiment, the DCR configured such that a player's hand is attached via the use of one or more attachment links provided at the tips of the fingers of glove 2802. In particular, a player's glove 2802 may be provided and having its fingers attached to frame mounts 2804 with straps 2806. The frame mounts 2804 may be fixed or movable on the frame 102. The frame mounts 2804 may also comprise various tensioning mechanisms, such as a screw, to allow for adjustment of the tension of straps 2806.

The straps 2806 may be constructed from various materials, such as wire, plastic, rubber, nylon, etc. The straps 2806 may come in various sizes to suit different player's hands and to provide a range of tensions. The straps 2806 may be configured to be rigid or to have various elasticity characteristics depending on the desired playability and feel of the DCR. In one embodiment, the straps 2806 are constructed from a metal or plastic to provide a rigid connection. Alternatively, the straps 2806 may be constructed from an elastic material, such as rubber or nylon.

In another embodiment, the glove 2802 may have a plastic (or other material) clip at its fingertips that would clip into a receptacle on the frame 102, or an extension of the frame, such as mounts 2804. The clips may be attached to the fingertips by various means, such as by an adhesive or stitching. In this embodiment, portions of the frame 102 are extended by mounts 2804 to almost meet the fingers of glove 2802. To provide an attachment mechanism, the mounts 2803 may comprise female receptacle (not shown) that mates to a male clip on the tip of each finger of the glove 2802. Alternatively, the male and female connections may be reversed, i.e., the male clip may be provided on mounts 2803 and the female clip may be provided on the tips of glove 2802. Any form of fastener or attachment may be used in this embodiment In the embodiment shown, each finger of the glove 2802 is provided it's own link 2806. In other embodiments, the fingers of the glove 2802 may share one or more links. In yet other embodiments, only certain fingers of the glove, such as the thumb, forefinger, etc., may be provided a strap.

Figure 28B:
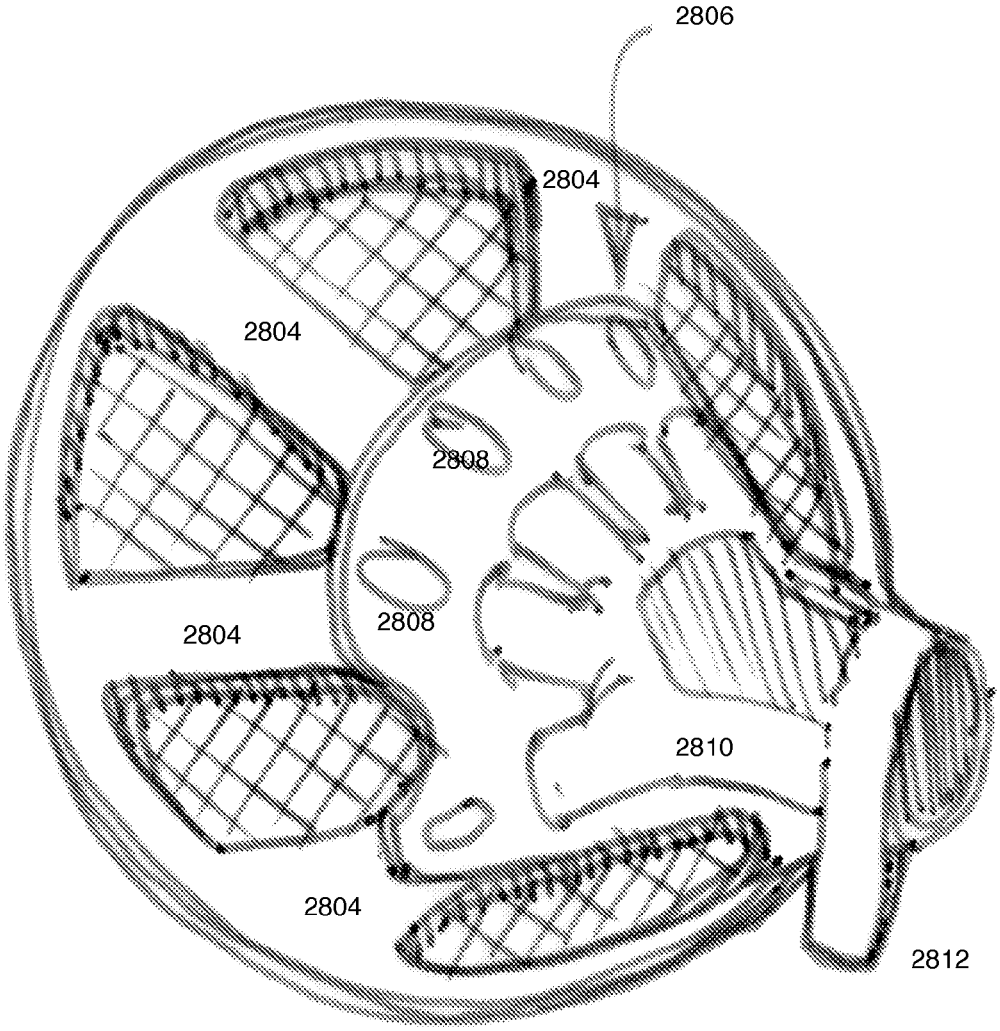
FIG. 28B shows another embodiment of a direct contact racquet that employs a glove.

FIG. 28B shows another embodiment of the direct contact racquet that also employs a glove. In this embodiment, a player may insert their hand in a glove 2810 and secure their wrist with strap 2812 to the direct contact racquet. The glove 2810 may be attached to the gripping surface 2806, such as, by a clip, stitching, Velcro, or an adhesive. The glove 2810 may be detachable from the direct contact racquet. In the embodiment shown, the glove 2810 is a partial glove that allows for the player's finger to partially protrude. In other embodiments, the glove 2810 may fully enclose the fingers of the player.

In addition, the mounts 2804 extend and connect to a gripping surface 2806. The gripping surface 2806 may also comprise holes or slots 2808 holding the fingers of the player. Furthermore, the gripping surface 2806 may comprise loops, caps, etc., (not shown) in which a player may insert their fingers.

Figure 29:
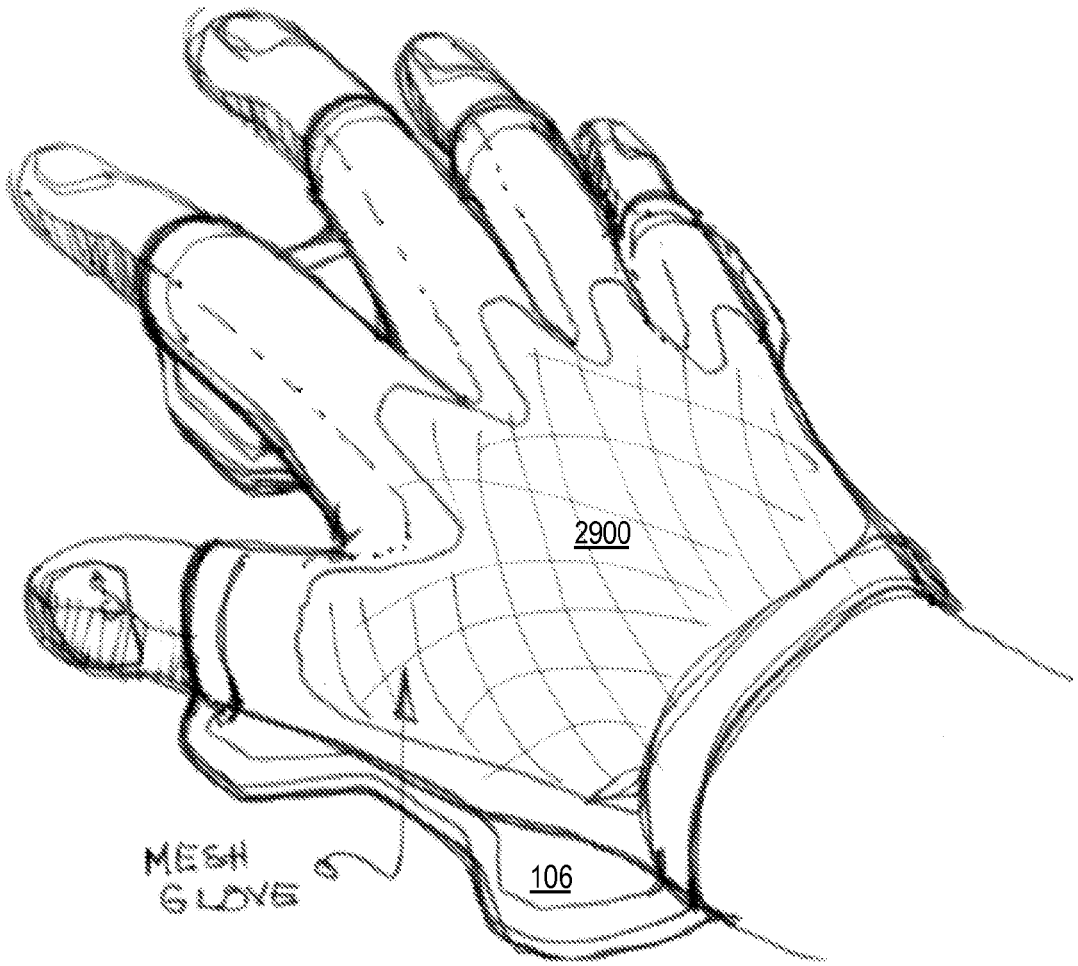
FIG. 29 shows an exemplary embodiment for attaching a player's hand to the direct contact racquet.

FIG. 29 shows an exemplary embodiment for attaching a player's hand to the direct contact racquet. In this embodiment, a player's hand may be partially enclosed in a glove 2900 with or without fingers. In addition, the gripping surface 106 may comprise loops or straps for the fingers of the player's hand and the wrist of the player.

Figure 30:
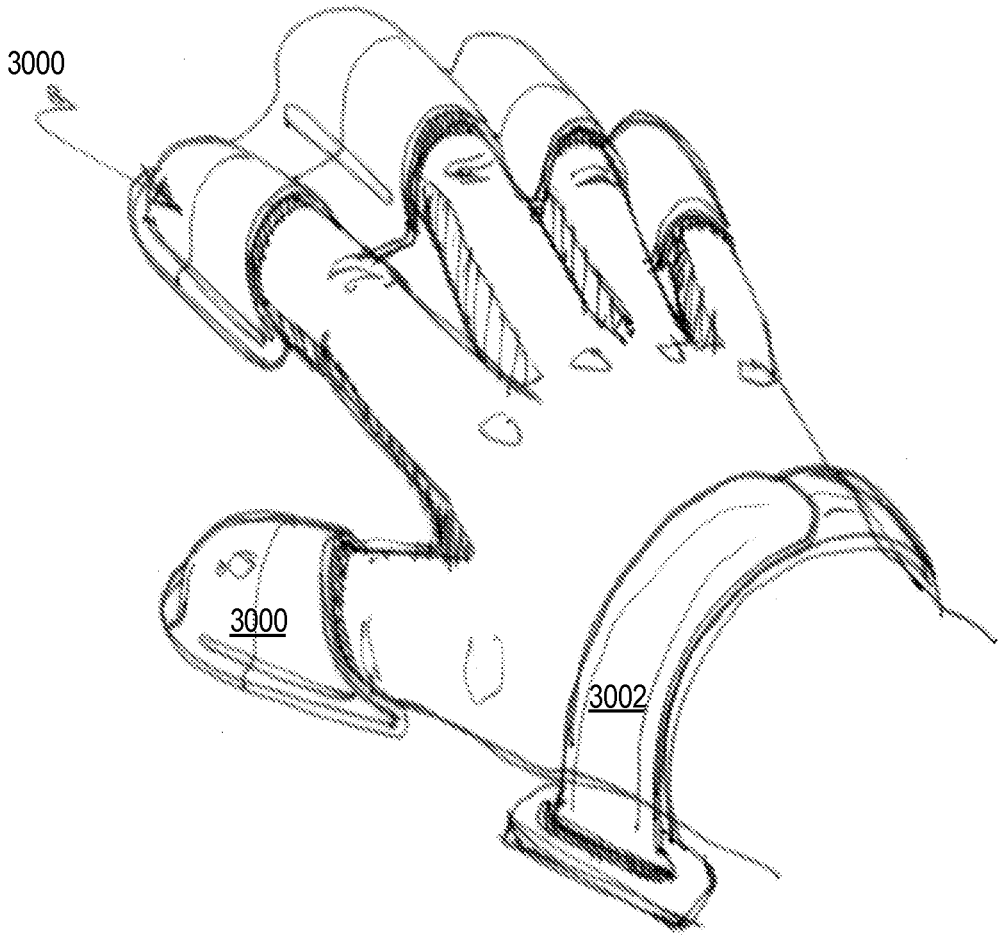
FIG. 30 shows a second embodiment for attaching a player's hand to the direct contact racquet.

FIG. 30 shows a second embodiment for attaching a player's hand to the direct contact racquet. In this embodiment, the fingertips of the player's hand are enclosed in caps 3000. These caps 3000 may be placed at appropriate locations on the gripping surface 106 (not shown in FIG. 30). The caps 3000 may be constructed from various materials, such as plastic, nylon, etc. In addition, as shown, a wrist strap 3002 may be provided for the player. Any number of straps may be provided in the embodiments.

Figure 31:
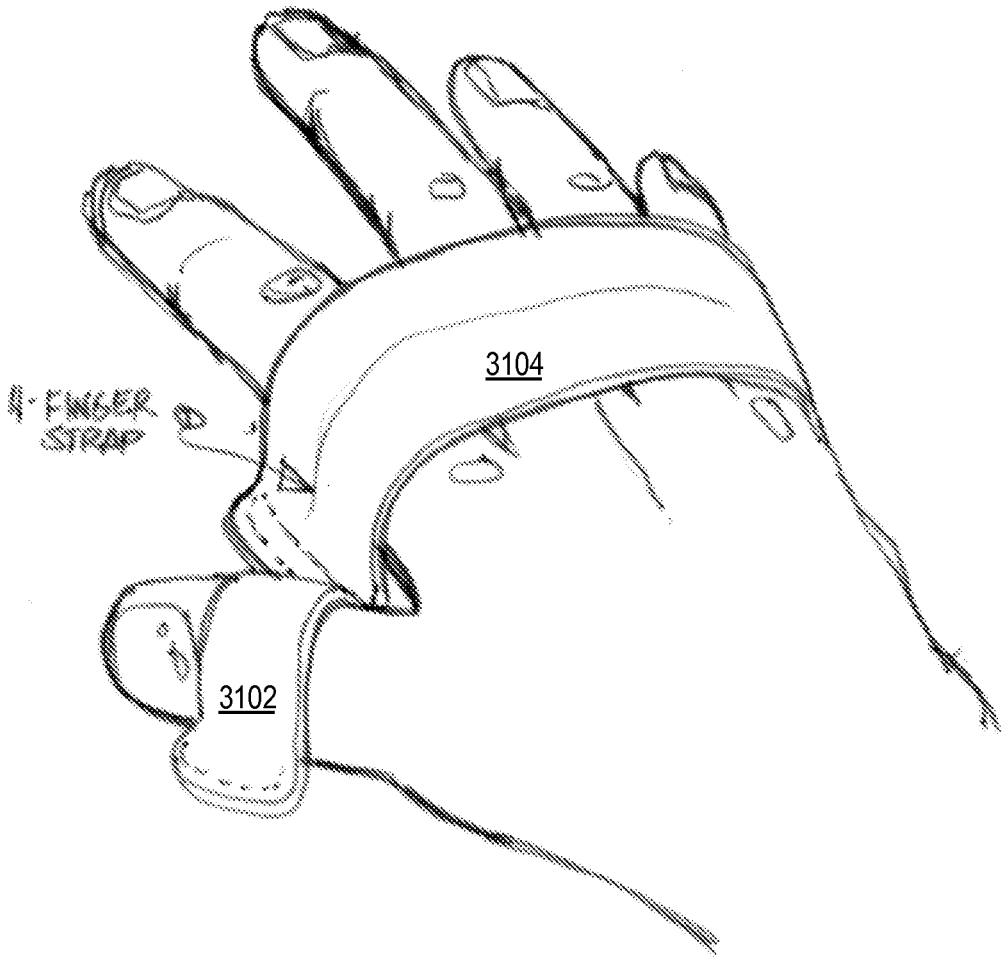
FIG. 31 shows a third embodiment for attaching a player's hand to the direct contact racquet.

FIG. 31 shows a third embodiment for attaching a player's hand to the direct contact racquet. In this embodiment, a strap 3100 may span across one or more knuckles of the player's hand. In addition, as shown, a thumb strap 3102 may be provided over any portion of the finger, such as one or more knuckles of the player's fingers. The straps 3100 and 3102 may be attached to the gripping surface 106 (not shown in FIG. 31), for example, with a buckle, a fastener, Velcro, etc.

Figure 32:
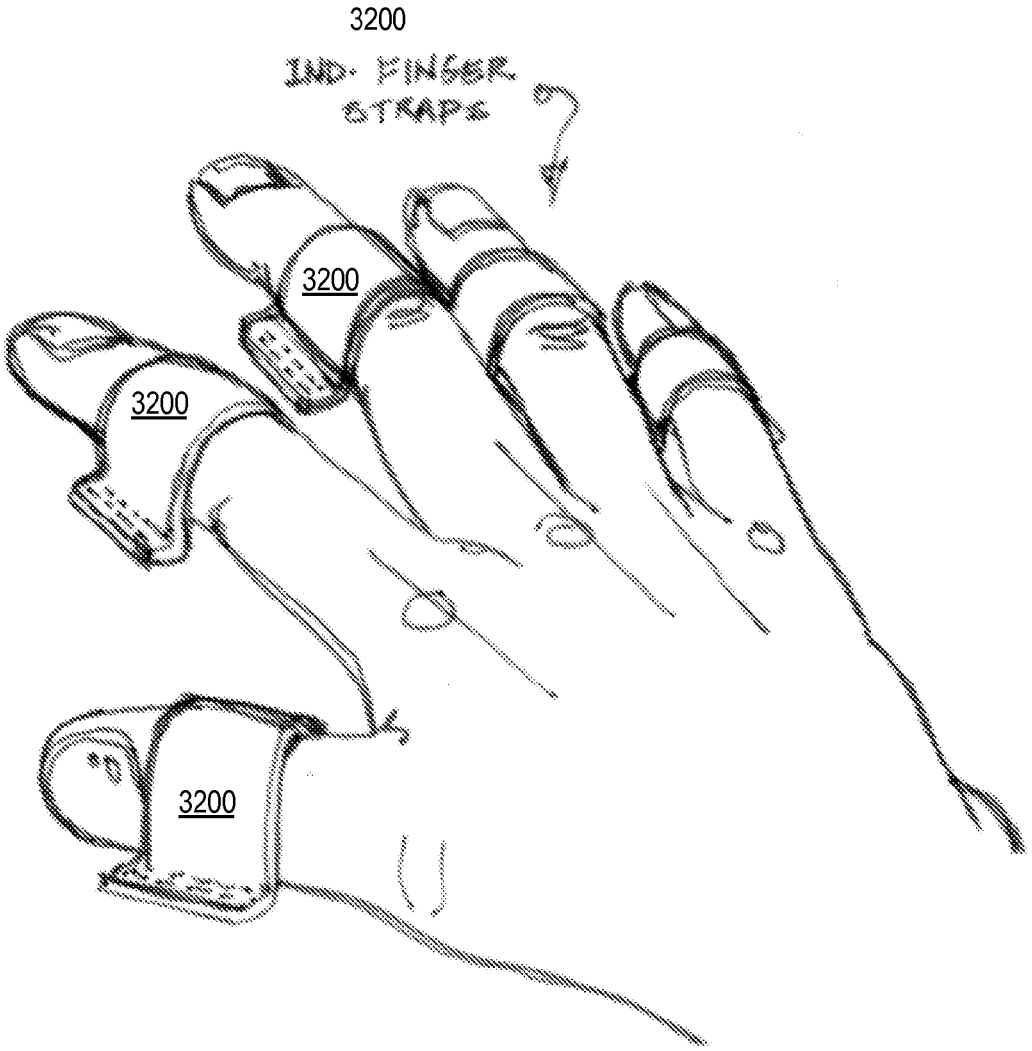
FIG. 32 shows a fourth embodiment for attaching a player's hand to the direct contact racquet.

FIG. 32 shows a fourth embodiment for attaching a player's hand to the direct contact racquet. In this embodiment, individual finger straps 3200 may be provided over one or more knuckles of the player's hand. The straps 3200 may be attached to the gripping surface 106 (not shown in FIG. 32), for example, with a buckle, a fastener, Velcro, etc.

Figure 33:
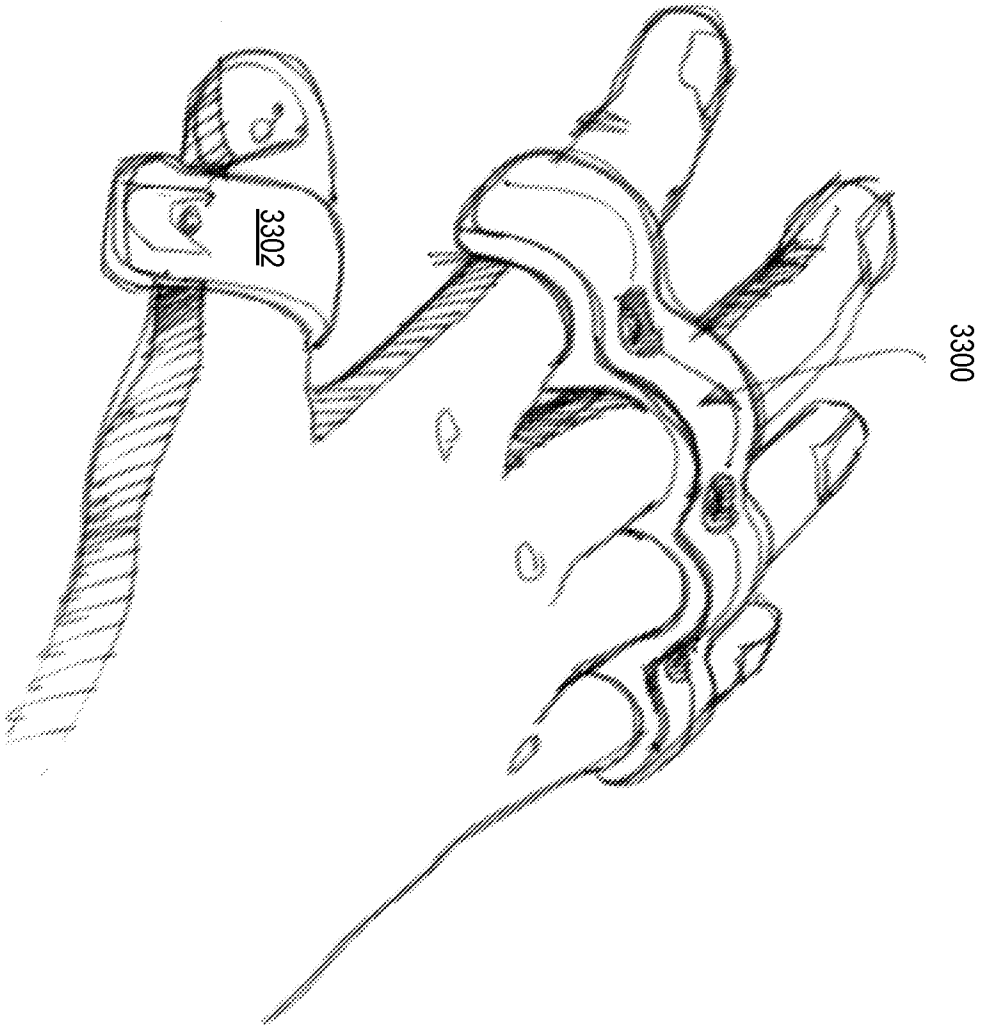
FIG. 33 shows a fifth embodiment for attaching a player's hand to the direct contact racquet.

FIG. 33 shows a fifth embodiment for attaching a player's hand to the direct contact racquet. In this embodiment, a bridge 3300 is provided and configured to span over one or more knuckles of fingers of the player's hand. As shown, the bridge 3300 may be a molded structure made from plastic, graphite, etc. and may have holes or slots for one or more fingers. As also shown, a thumb bridge 3302 may be provided for the player's thumb as an individual piece that is separate from the bridge 3300. In other embodiments, the bridges 3300 and 3302 may be a single piece.

Figure 34:
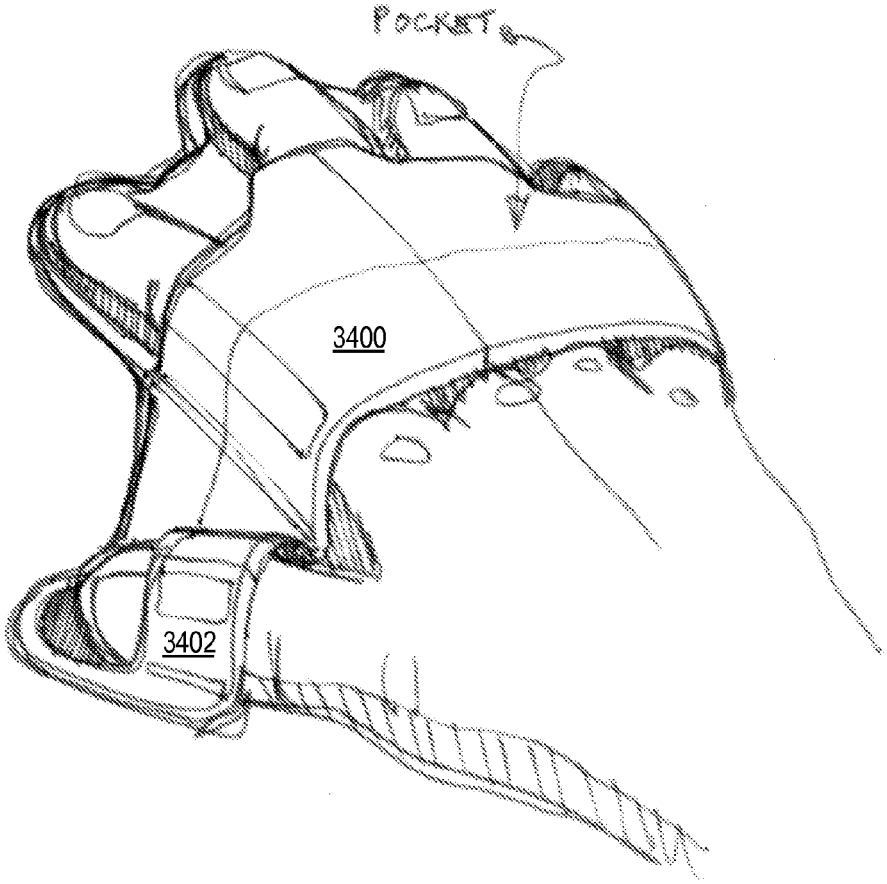
FIG. 34 shows a sixth embodiment for attaching a player's hand to the direct contact racquet.

FIG. 34 shows a sixth embodiment for attaching a player's hand to the direct contact racquet. In this embodiment, a finger pocket 3400 is provided over the player's fingers. As shown, the finger pocket 3400 may provide a thumb pocket 3402 and main pocket 3404. The finger pocket 3400 may be open to allow for fingers to protrude. Alternatively, the finger pocket 3400 may enclose one or more of the player's fingers and/or thumb.

The finger pocket 3400 may provide one or more walls to separate the player's fingers or may provide a common pocket for multiple fingers. The finger pocket 3400 may be attached to the gripping surface 106 (not shown in FIG. 34), for example, with Velcro, a fastener, a clip, etc. The finger pocket 3400 may be constructed from various materials, such as plastic, graphite, leather, and the like.

Figure 35:
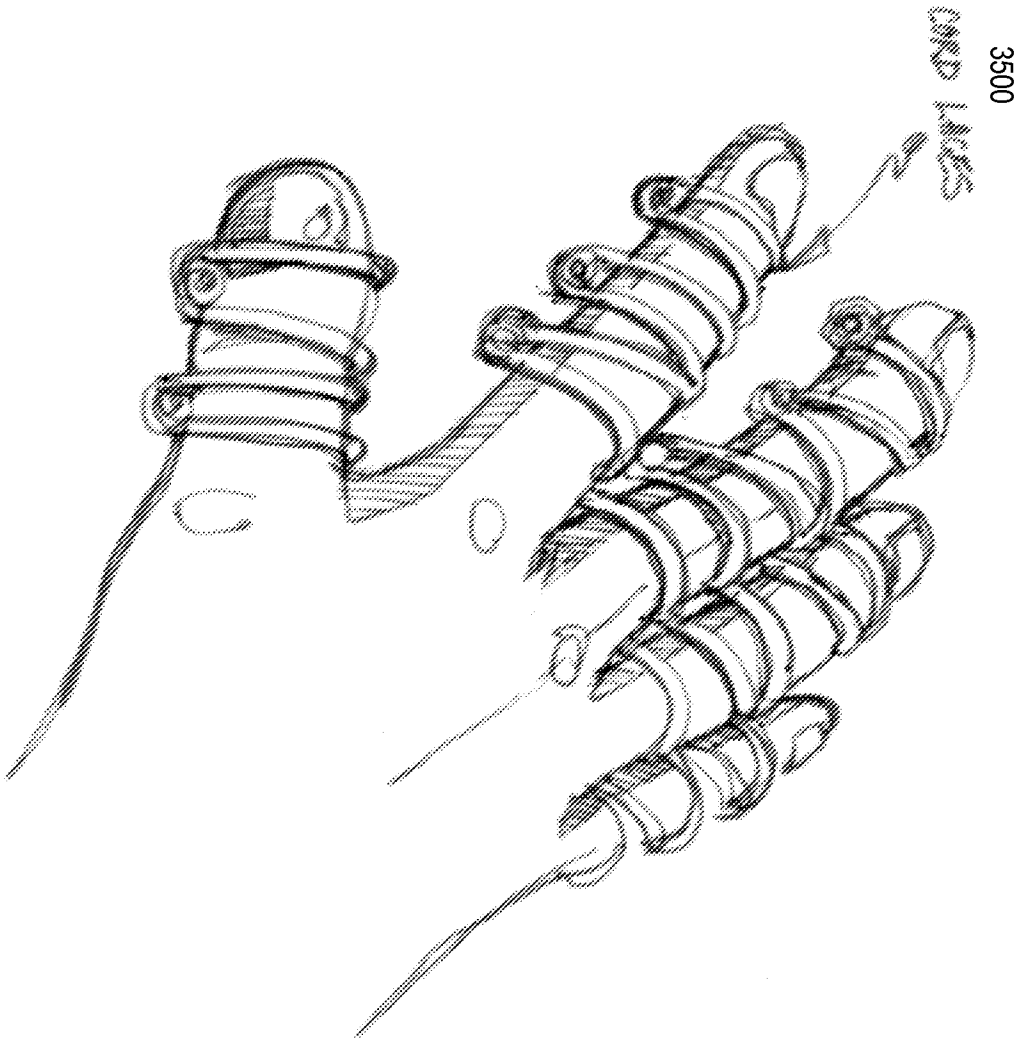
FIG. 35 shows a seventh embodiment for attaching a player's hand to the direct contact racquet.

FIG. 35 shows a seventh embodiment for attaching a player's hand to the direct contact racquet. In this embodiment, cord laces 3400 are provided over the player's fingers. The cord laces 3500 may be constructed from an elastic material, such as nylon, rubber, etc. and attached to the gripping surface 106 (not shown in FIG. 35). The cord laces 3500 may span one or more knuckles of each finger. In addition, the cord laces 3500 may be adjusted to a desired tension for comfort of the player.

Figure 36A:
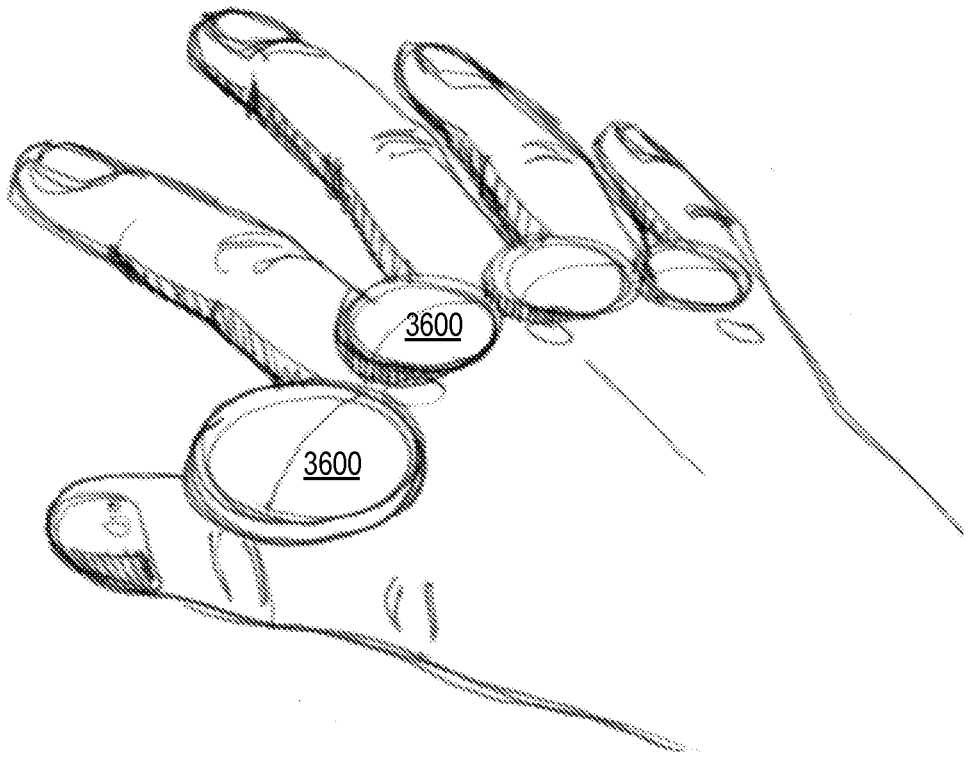
FIGS. 36A-36B show an eighth embodiment for attaching a player's hand to the direct contact racquet.
Figure 36B:
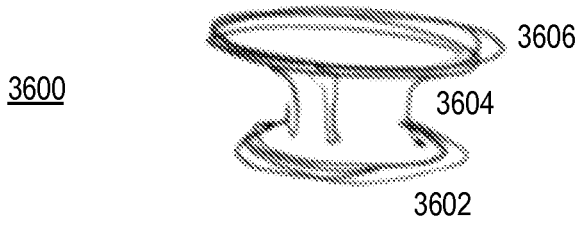

FIGS. 36A-36B show an eighth embodiment for attaching a player's hand to the direct contact racquet. In this embodiment, a plurality of pedestals 3600 are provided between the fingers of the players hand. As shown, the pedestals 3600 may comprise a base 3602 attached to the gripping surface 106 (not shown), a column 3604, and a cap 3606. The pedestals 3600 may be constructed from various materials, such as plastic, metal, etc.

In the embodiments, the pedestals 3600 may be provided in various sizes and shapes to suit individual players. In addition, the pedestals 3600 may comprise various features for comfort, such as cushions.

Figure 37:
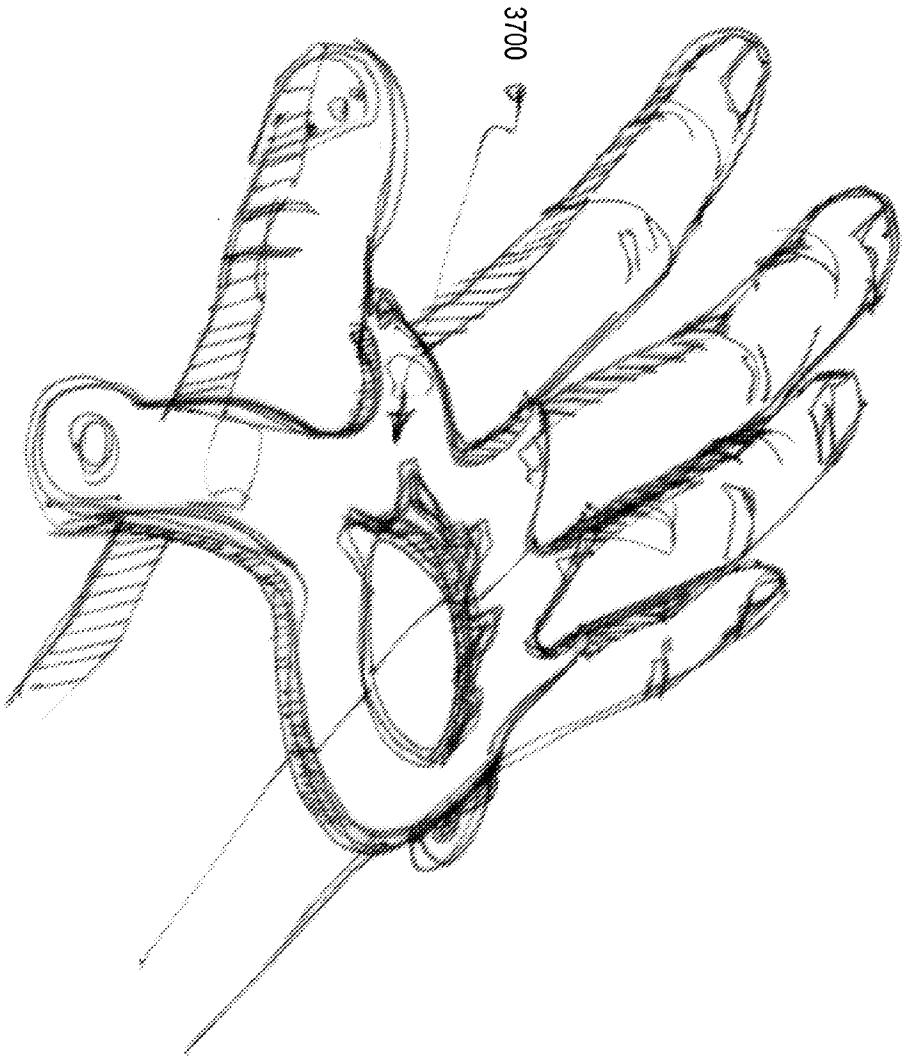
FIG. 37 shows a ninth embodiment for attaching a player's hand to the direct contact racquet.

FIG. 37 shows a ninth embodiment for attaching a player's hand to the direct contact racquet. In this embodiment, a hand loop 3700 is provided over the back of the player's hand. As shown, the loop 3700 may comprise one or more openings through which a player may extend their fingers. The loop 3700 may comprise any number of openings. For example, as shown, the loop 3700 may comprise openings for each finger. Alternatively, the loop 3700 may comprise one or more openings that are shared by multiple fingers.

In addition, the loop 3700 may comprise various features for comfort, such as cushioned backing or a cutout. The hand loop 3700 may be constructed from various materials, such as plastic, rubber, etc., alone or in combination.

Figure 38:
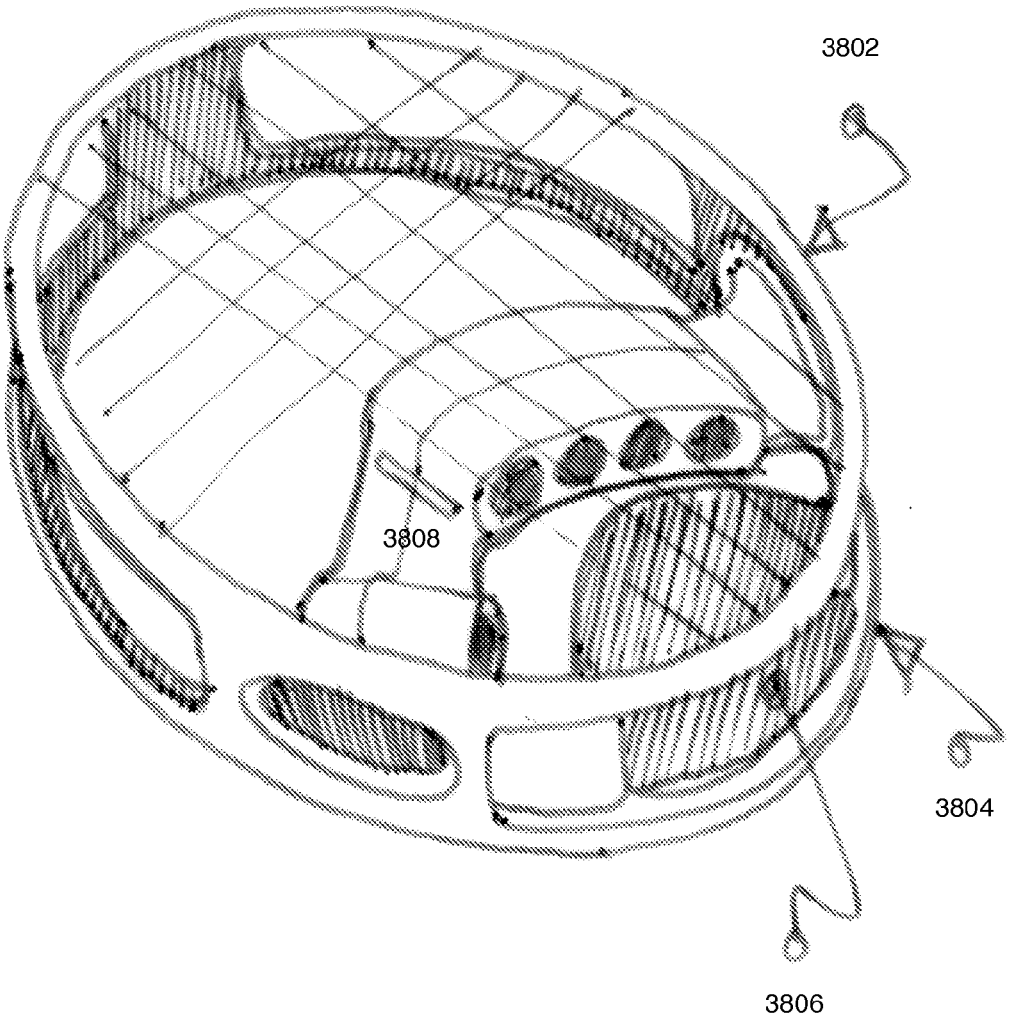
FIG. 38 shows an embodiment for a dual-sided direct contact racquet.

FIG. 38 shows an embodiment for a dual-sided direct contact racquet. As shown, the direct contact racquet may provide a frame on either side of a player's hand, such as a top frame 3802 and a bottom frame 3804. The frames 3802 and 3804 may be connected together at various points to provide structure support and to provide a space in which the player may insert their hand. The frames 3802 and 3804 may be an integrated, singular piece or modular in construction to allow for either of frames 3802 or 3804 to detach from each other.

As shown, the gripping surface 106 may comprise a palm rest 3806 to provide a resting surface for the player's hand. In addition, a cross bar 3808 (or gripping bar) may be provided between the frames 3802 and 3804. In the embodiment shown, the cross bar 3808 may comprise finger holes in which the player may insert one or more of their fingers. The finger holes may comprise various features such as cushioning or pads for the comfort of the player. In addition, the finger holes may be adjustable in size to accommodate different sizes or different numbers of fingers.

The cross bar 3808 may be configured with various widths to enclose different lengths of the player's fingers. For example, as shown in FIG. 38, the cross bar 3808 is configured to enclose a portion of the player's finger. In other embodiments, the cross bar 3808 may comprise grooves or slots that enclose the finger rather than the pass-through structure shown.

The cross bar 3808 may be detachable from either of frames 3802 and 3804 for adjustment and/or replacement. In the embodiment shown, the cross bar 3808 is configured as a vertical piece. However, in other embodiments, the cross bar 3808 may be angled depending on the desired positioning of the player's fingers in the cross bar 3808.

As shown, the cross bar 3808 may have various shapes to accommodate the individual fingers of the user or player. For example, the cross bar 3808 may have a shape that thickens depending on the length of the finger or curves to present an ergonomic interface to each finger. In one embodiment, the fingers may protrude through the cross bar 3808 such that the fingertips are exposed. In another embodiment, the cross bar 3808 may be contoured and shaped to enclose the fingers of the user or player.

The features and attributes of the specific embodiments disclosed above may be combined in different ways to form additional embodiments, all of which fall within the scope of the present disclosure. Although certain embodiments have been disclosed, other embodiments that are apparent to those of ordinary skill in the art, including embodiments, which do not provide all of the features and advantages set forth herein, are also within the scope of this disclosure.

The invention claimed is:

1. A racquet for use with a ball, said racquet comprising:

a first frame comprising a string bed for striking a ball;

a gripping member comprising a convex arch spanning across the first frame, the gripping member configured to accommodate a hand of a user, wherein the gripping member further comprises a set of adjustable holes or slots, each of said holes or slots for receiving a finger of the hand of the user; and a strap attached to the first frame for securing the racquet to the user's hand or wrist.

2. The racquet of claim 1, wherein the adjustable holes or slots permit the user to increase or decrease the size of the holes or slots to accommodate different sizes of fingers.

3. The racquet of claim 1, further comprising finger caps for securing the user's fingers to the gripping member.

4. The racquet of claim 1, wherein the convex arch is adjustable to permit the user to adjust the curvature of the convex arch.

5. The racquet of claim 1, further comprising a second frame coupled to the first frame, the second frame comprising a string bed for striking a ball, wherein the gripping member is interposed between the first frame and the second frame.

6. The racquet of claim 1, wherein the gripping member further comprises a contoured portion to accommodate a palm of the user's hand.

7. The racquet of claim 1, wherein the gripping member further comprises a roughened surface.

8. The racquet of claim 1, wherein the gripping member is detachable from the frame.

9. The racquet of claim 1, wherein the gripping member is configured to provide a clearance for deflection of the string bed when the racquet strikes a ball.

10. The racquet of claim 1, wherein the frame is oval in shape and larger than the hand of the user.

* * * * *